US006471429B1

(12) United States Patent
Isobe et al.

(10) Patent No.: US 6,471,429 B1
(45) Date of Patent: Oct. 29, 2002

(54) SHEET PROCESSING APPARATUS FOR DISCHARGING SHEETS IN A BUNDLE

(75) Inventors: Yoshinori Isobe; Katsuhito Kato; Yuzoh Matsumoto, all of Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/493,687

(22) Filed: Jan. 28, 2000

(30) Foreign Application Priority Data

Jan. 29, 1999 (JP) ..... 11-021673
Jan. 29, 1999 (JP) ..... 11-021675
Jan. 29, 1999 (JP) ..... 11-021676
Jan. 29, 1999 (JP) ..... 11-021680

(51) Int. Cl.[7] ..... B41J 11/42

(52) U.S. Cl. ..... 400/582; 270/58.09; 270/58.12; 270/58.13; 271/3.01; 271/3.02; 271/3.03

(58) Field of Search ..... 400/582; 270/58.07–58.19; 271/3.01, 3.02, 3.03, 3.12, 3.13, 3.14, 3.15, 3.17

(56) References Cited

U.S. PATENT DOCUMENTS 5,098,074 A * 3/1992 Mandel et al. ..... 270/58.13
5,137,265 A * 8/1992 Sato et al. ..... 270/58.12
5,282,611 A 2/1994 Ueda et al. ..... 270/53
5,288,062 A * 2/1994 Rizzolo et al. ..... 270/58.12
5,351,112 A 9/1994 Naito et al. ..... 355/233
5,497,984 A * 3/1996 Murakami et al. ..... 270/58.02
5,579,083 A 11/1996 Naito et al. ..... 355/50
5,580,045 A 12/1996 Matsumoto et al. ..... 271/298
5,700,002 A 12/1997 Kato et al. ..... 270/58.12
5,722,030 A 2/1998 Kato ..... 399/403
5,819,151 A 10/1998 Naito et al. ..... 399/367
5,897,250 A 4/1999 Hirai et al. ..... 399/404
5,911,414 A 6/1999 Kato et al. ..... 270/58.07
6,145,825 A * 11/2000 Kunihiro et al. ..... 270/58.09
6,145,826 A * 11/2000 Kawata ..... 270/58.28

* cited by examiner

*Primary Examiner*—Andrew H. Hirshfeld
*Assistant Examiner*—Minh H. Chau
(74) *Attorney, Agent, or Firm*—Fitzpatrick, Cella, Harper & Scinto

(57) ABSTRACT

Sheet processing apparatus including a first tray for stacking sheets received from an image forming apparatus, a discharge unit for discharging the sheets from the first tray in a bundle, a second tray for stacking the sheets discharged from the first tray, a discriminating unit for discriminating an attribute of a sheet to be stacked on the first tray, and a controller for selectively controlling whether or not to discharge sheets by the discharge unit in accordance with a discrimination of the discriminating unit.

42 Claims, 23 Drawing Sheets

109
SCANNED IMAGE
(0,0)
180° ROTATED IMAGE
(0,0)
110
111
a

SHEET PROCESSING APPARATUS FOR DISCHARGING SHEETS IN A BUNDLE

BACKGROUND OF THE INVENTION

1. Field of the Invention

The present invention relates to sheet processing for stacking sheets on a first tray and then discharging the sheets to a second tray in a bundle.

2. Description of the Related Art

A conventional sheet processing apparatus stacks sheets, which are discharged from an image forming apparatus such as a copy machine, on a process tray and staples the sheets on the process tray and discharges the sheets onto a stack tray in a bundle. The sheets on the process tray are discharged by a roller provided above the process tray or discharged by a belt provided below the process tray. In a case where a roller discharges the sheets, the roller waits in a position above the process tray, and then discharges the sheets by moving down on the sheets. In a case where a belt discharges the sheets, a hook provided on the belt discharges the sheets when the belt rotates. The conventional sheet processing apparatus discharges sheets from the process tray to the stack tray for each completion of an image formation job of the image forming apparatus.

It is common for users to make copies on various different kinds of sheets such as a thin sheet for a drawing and a transparent sheet for an over head projector. However, problems arise when different kinds of sheets are transported to the sheet processing apparatus. For example, a stack of thin sheets is not discharged well from the process tray and is not stacked well on the stack tray, because a thin sheet has a weak stiffness. A stack of transparent sheets may move sheets stacked on the stack tray when the stack of transparent sheets is discharged to the stack tray, because a transparent sheet tends to be charged by static.

SUMMARY OF THE INVENTION

An object of the present invention is to provide a sheet processing apparatus which can treat various different kinds of sheets with a good stack condition.

In order to achieve the above object, the present invention provides sheet processing apparatus comprising a first tray for stacking sheets received from an image forming apparatus, a discharge unit for discharging the sheets from said first tray in a bundle, a second tray for stacking the sheets discharged from said first tray, a discriminating unit for discriminating an attribute of a sheet to be stacked on said first tray, and a controller for selectively controlling whether or not to discharge by said discharge unit in accordance with a discrimination of said discriminating unit.

More specifically, in the sheet processing apparatus, said discriminating unit discriminates if the sheet is a thin sheet, and wherein said controller controls said discharge unit not to discharge the sheets when the sheet is a thin sheet and to discharge the sheets when the sheet is not a thin sheet.

Also, the sheet processing apparatus further comprises a detector for detecting a sheet stacked on said first tray, wherein said sheet processing apparatus receives a sheet from an image forming apparatus, and wherein said controller controls said discharge unit in accordance with the sheet being detected by said detector when the image forming apparatus starts an image formation.

Also, in the sheet processing apparatus, said controller includes a counter for weighted counting of sheets stacked on said first tray, with weighting corresponding to a size of the sheet, and wherein said controller controls said discharge unit to discharge sheets in accordance with a count result of said counter exceeding a predetermined value.

Also, the sheet processing apparatus further comprises a jogger for jogging sheets on said first tray, wherein said discriminating unit discriminates a width of a sheet, and wherein said controller controls said discharging unit to discharge sheets in accordance with a width of a coming sheet being different from a width of a sheet stacked on said first tray.

Also, in the sheet processing apparatus, said discriminating unit discriminates if a sheet is fed from a manual feeding unit, and wherein said controller controls said discharging unit to discharge sheets in accordance with first predetermined number of sheets being fed from a feeding unit other than the manual feeding unit and to discharge sheets in accordance with a second number, which is smaller than the first number, of sheets being fed from the manual feeding unit.

In another aspect of the invention, the present invention provides Sheet processing method comprising stacking sheets transported from an upstream on a first tray, discriminating an attribute of a sheet stacked on said first tray, and selectively controlling whether or not to discharge sheets from said first tray to a second tray in a bundle in accordance with a discrimination of said discriminating step.

In another aspect of the invention, the present invention provides a recording medium, which includes code for process steps that can be read by a controller of a sheet processing apparatus, said code comprising code for stacking sheets transported from an upstream on a first tray, code for discriminating an attribute of a sheet to be stacked on said first tray, and code for selectively controlling whether or not to discharge sheets from said first tray to a second tray in a bundle in accordance with a discrimination by said discriminating code.

Other objects and features of the invention will be apparent from the following description and the drawings.

DESCRIPTION OF THE PREFERRED EMBODIMENTS

Figure 1:
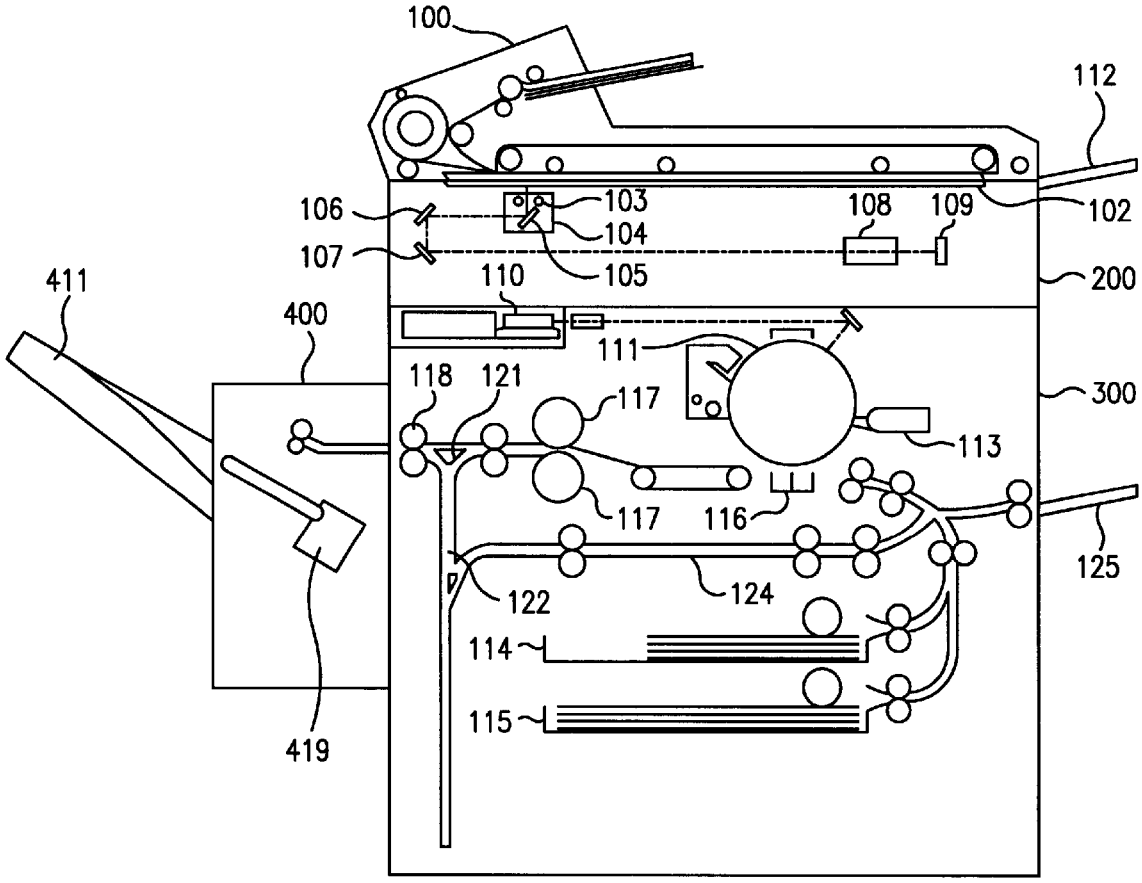
FIG. 1 shows an image forming apparatus and a sheet processing apparatus.

FIG. 1 shows an image forming apparatus and sheet processing apparatus. The image forming apparatus includes reader 200 and printer 300. Document feeder 100 is provided to reader 200. Document feeder 100 feeds documents set on a document tray to discharge tray 112 through plate glass 102 along paths counterclockwise one by one. Meanwhile, the documents are set on the document tray in a face-up state by a user and fed in a page order. The document is illuminated by lamp 103 of scanner unit 104 and the reflected light from the document is led to lens 108 through mirror 105, 106 and 107. The light going through lens 108 is read by image sensor 109.

Image sensor 109 outputs image data in accordance with the document image to exposure controller 110. Exposure controller 110 emits a laser beam in accordance with the image data. The laser beam is led to photosensitive drum 111. An electrostatic latent image is formed on photosensitive drum 111 in accordance with the laser beam. The electrostatic latent image is visualized by developing unit 113 as a toner image. Meanwhile, a sheet is fed from one of cassette 114, 115, manual feed unit 125 and re-feed path 124 in sync with the time the laser beam is emitted. The sheet is fed to transfer unit 116. The toner image on photosensitive drum 111 is transferred to the fed sheet by transfer unit 116.

The sheet with the transferred toner image is transported to fixing unit 117. Fixing unit 117 fixes the toner image to the sheet by heat and pressure. The fixed sheet is led to path 122 by flapper 121 and is transported in the opposite direction after the trailing edge of the sheet goes through flapper 121. Then the sheet is discharged out of printer 300 by discharge roller 118 in a face-down state in which the toner image faces downward. This discharge manner is referred to as an inversion discharge. When image data is formed from the first page in a page order such as when document feeder 100 is used and when the image data is generated by a computer, the inversion discharge is done in order to make the page order correct.

When sheets are fed from manual feeding unit 125, inversion discharge is not done, that is, the fixed sheet is discharged in a face-up state. Also, a hard sheet such as an OHP sheet may be set on manual feeding unit 125. In this case where only one document is copied, or when one or more documents are copied on only one sheet, the fixed sheet is discharged in the face-up state. The sheet discharged by discharge roller 118 is transported to sheet processing apparatus 400.

When a two sided copy is done, the fixed sheet is transported to path 122 by flapper 121 and transported to path 124.

Figures 2A, 2B, 2C, 2D, 2E:
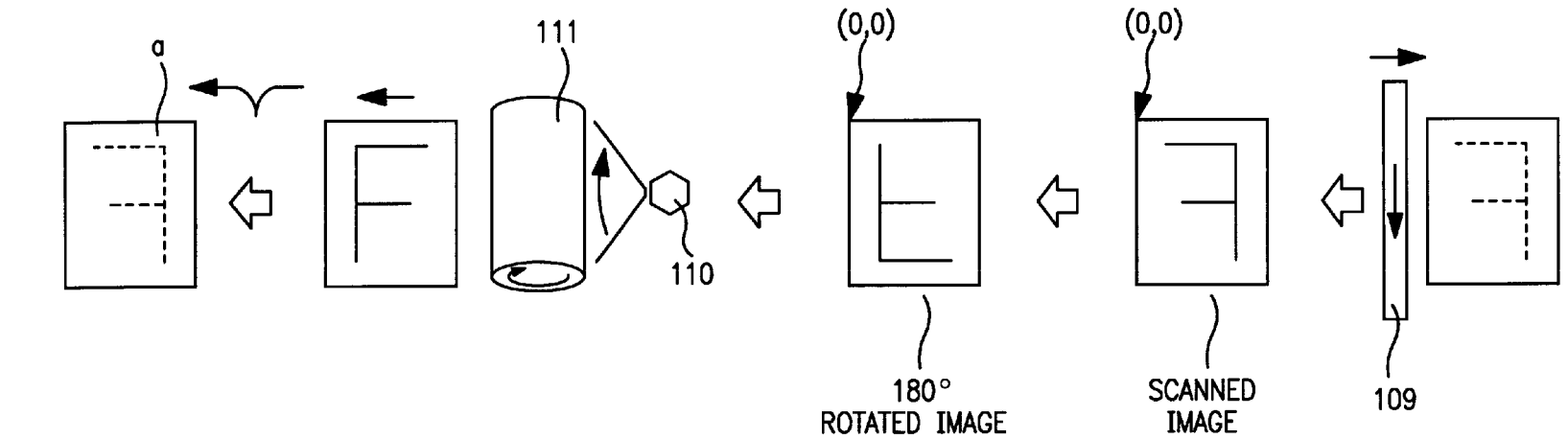
FIGS. 2(*a*) to 2(*e*) schematically depict an image formation process.

A copy process will be described hereinafter with reference to FIGS. 2(*a*) through 2(*e*). A document is scanned in the direction shown by the arrow in FIG. 2(*a*), during which the document is scanned by image sensor 109 as shown in FIG. 2(*b*). The document image is rotated by 180 degrees as shown in FIG. 2(*c*) and is formed on a sheet as shown in FIG. 2(*d*). Then, the sheet is inverted and is stapled at the trailing right edge of the sheet as shown at "a" in FIG. 2(*e*), so that the left edge of the image on the sheet is stapled. Main scanning directions of image sensor 109 and exposure controller 110 are shown by arrows in FIG. 2.

Figure 3:
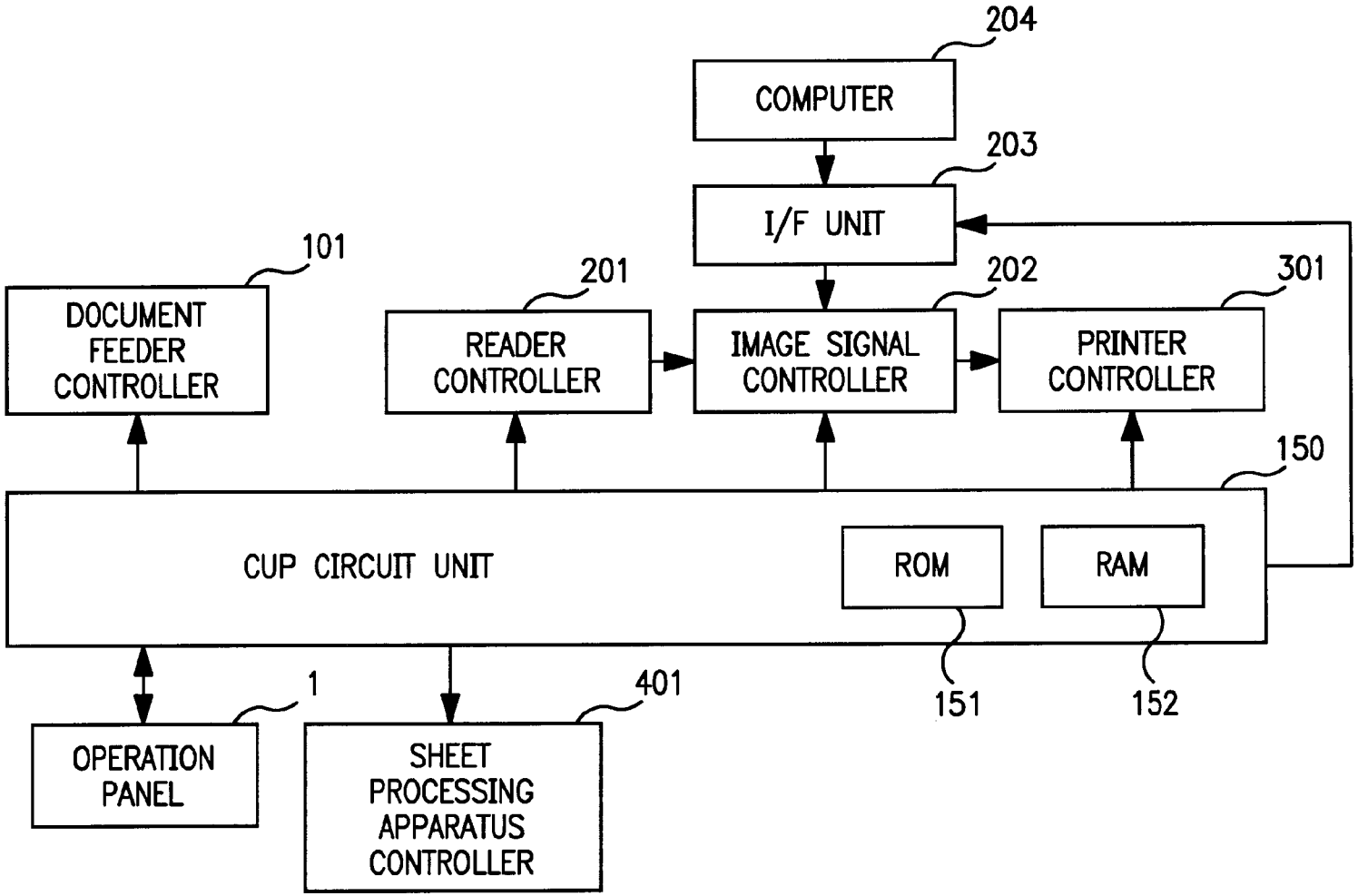
FIG. 3 shows a block diagram of a controller in the image forming apparatus.

FIG. 3 shows a block diagram of a controller controlling document feeder 100, reader 200, printer 300 and sheet processing apparatus 400. The controller includes CPU circuit unit 150. CPU circuit unit 150 includes a CPU (not shown), ROM 151 and RAM 152. CPU circuit unit 150 controls document feeder controller 101, reader controller 201, image signal controller 202, printer controller 301, sheet processing apparatus controller 401 and I/F unit 203 in accordance with a program stored in ROM 151 or RAM 152. For example, the program can be stored in a memory medium such as CD-ROM and floppy disc and can be read from the memory medium and can be stored in RAM 152 and can be executed by CPU circuit unit 150. RAM 152 stores control data temporarily.

Document feeder controller 101 controls document feeder 100. Reader controller 201 controls reader 200. Printer controller 301 controls printer 300. Sheet processing apparatus controller 401 controls sheet processing apparatus 400. I/F 203 receives image data from computer 204 and converts the image data into a bit map image and outputs the image to image signal controller 202. Image data read by image sensor 109 is outputted from reader controller 201 to image signal controller 202. The image data processed by image signal controller 202 is outputted to exposure controller 110 included in printer controller 301.

Figure 4:
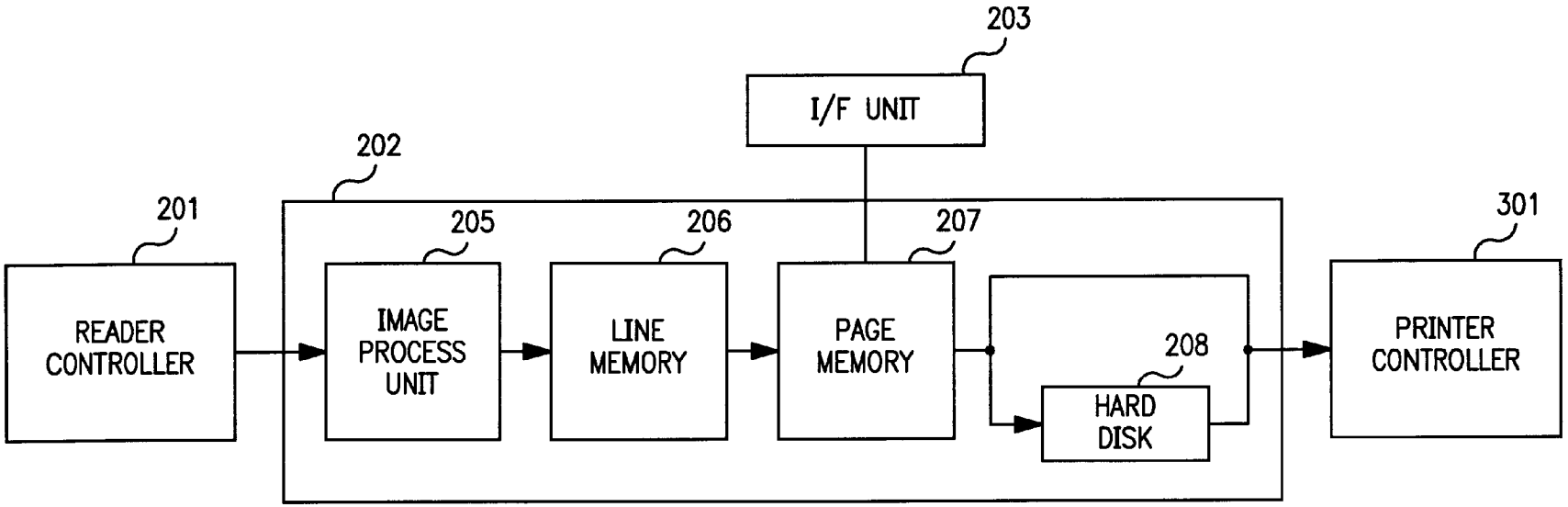
FIG. 4 shows a block diagram of an image signal control unit.

FIG. 4 shows a block diagram of image signal controller 202. Image process unit 205 does an image correction process and an image edit process. An image is outputted to printer controller 301 through line memory 206, page memory 207 and hard disc 208. Hard disc 208 is used for changing the page order of the image.

Figure 5:
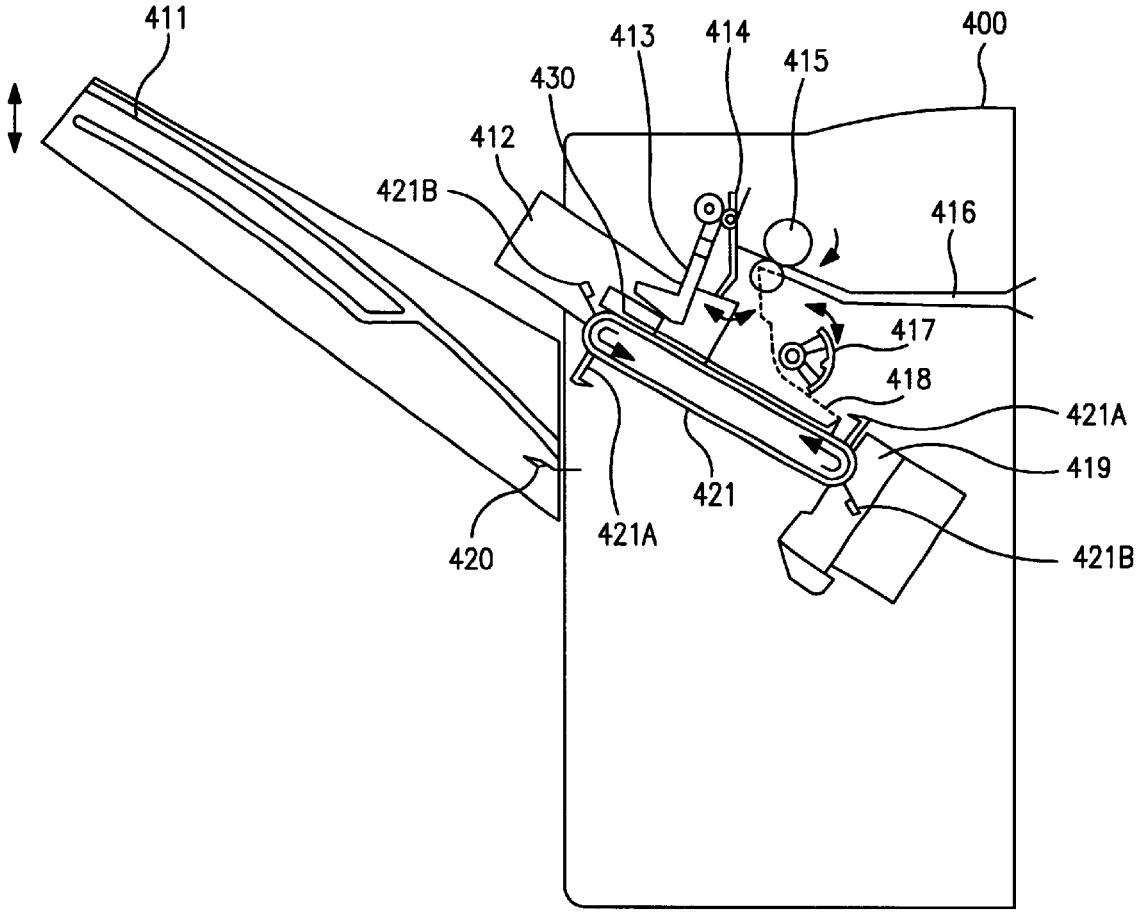
FIG. 5 shows a sheet processing apparatus.
Figure 20:
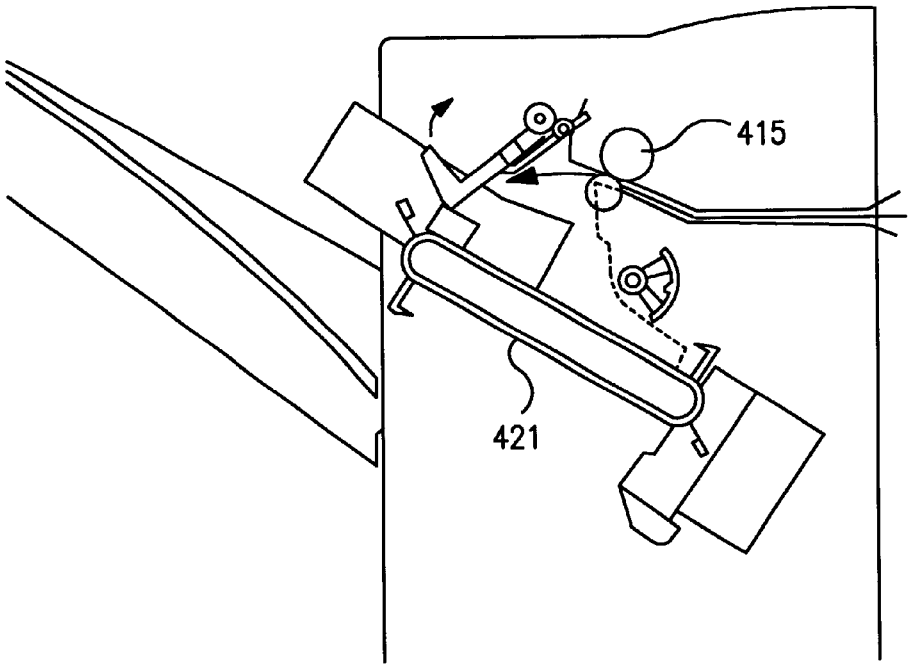
FIG. 20 shows a sheet discharged by roller 415.
Figure 21:
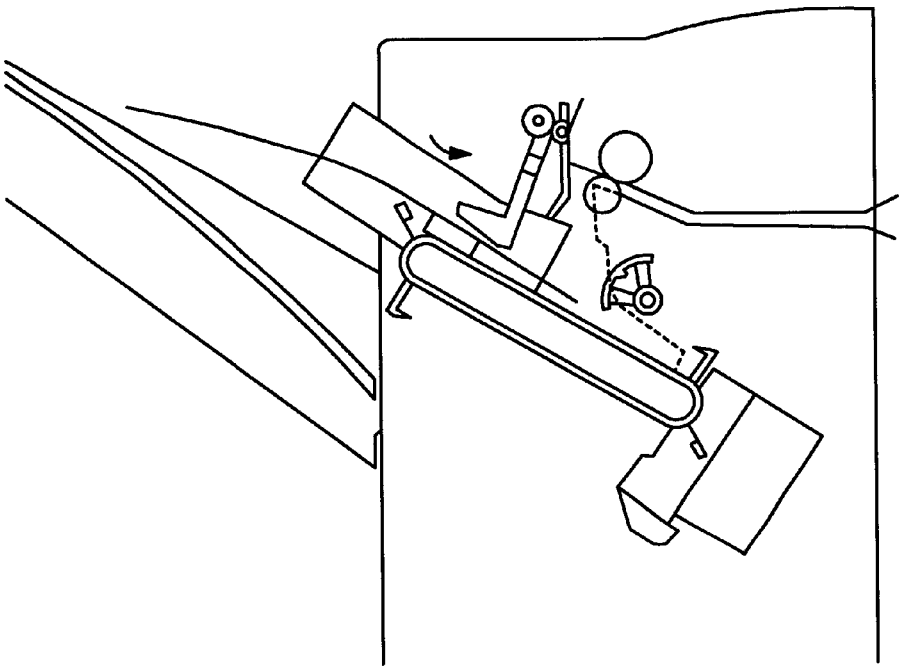
FIG. 21 shows a sheet discharged onto belt 421.
Figure 22:
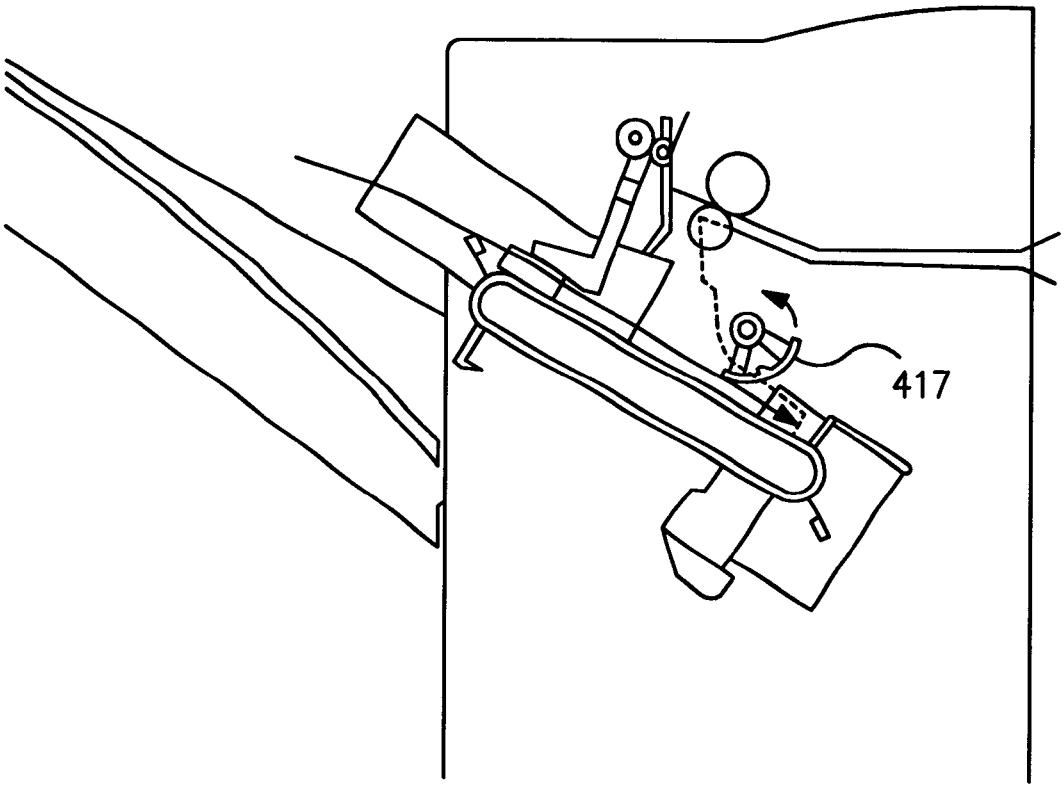
FIG. 22 shows a sheet on belt 421.
Figure 23:
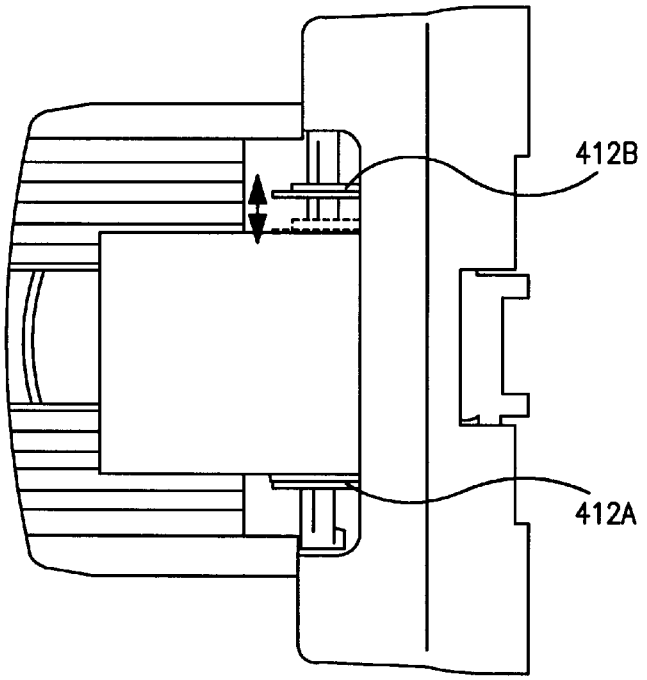
FIG. 23 shows a sheet jogged by jogger 412.
Figure 24:
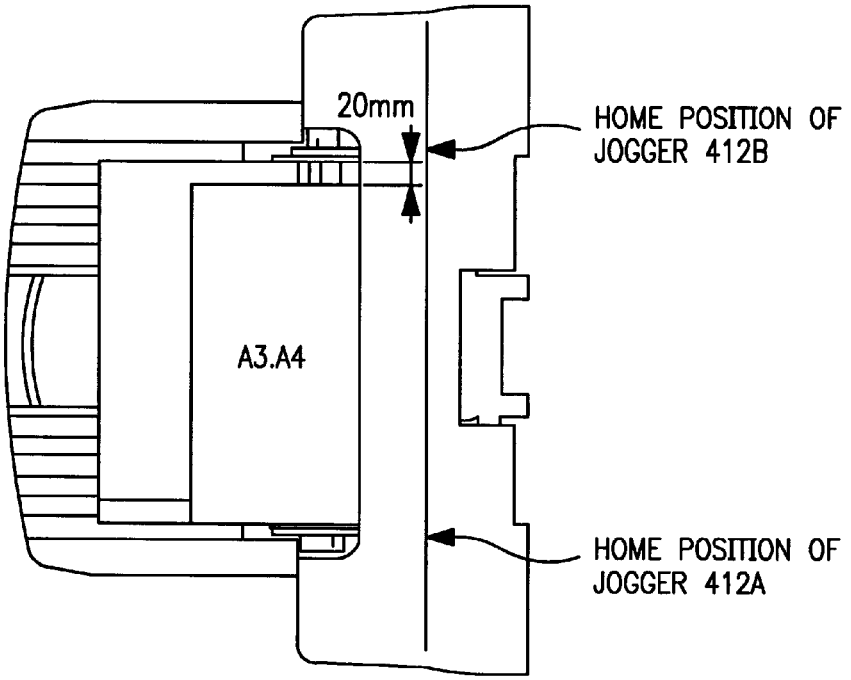
FIG. 24 shows sheets stacked on tray 411 and a sheet jogged on belt 421.

FIG. 5 shows sheet processing apparatus 400. A sheet received from printer 300 is fed to roller 415. Roller 415 discharges the sheet onto a process tray 430 which is provided a few millimeters above belt 421 as shown in FIG. 20. The process tray has a low friction. Guide plates 413 and 414 hang down and guide the sheet discharged by roller 415 downward as shown in FIG. 21. Then, the discharged sheet slips down toward the right along the process tray 430. Foot-shaped roller 417 has a high friction member such as a rubber on the arc thereof. The arc of roller 417 contacts with the sheet discharged on belt 421. The discharged sheet is moved toward the right by roller 417 until the sheet bumps into stopper 418 when roller 417 rotates counterclockwise as shown in FIG. 22. Stapler 419 is provided at the back side of sheet processing apparatus 400 and staples sheets stacked on belt 421. Stay 421B is provided on belt 421 and supports sheets stacked on belt 421 when the sheets are large. Stay 421B enlarges a stacking area on belt 421. Joggers 412 are provided at the front side and the back side of the sheet processing apparatus 400 and jogs a sheet on belt 421 as shown in FIG. 23. Joggers 412 make a shifted sheet stacks in which sheets are stacked either in the direction of the front side or the back side as shown in FIG. 24.

Figure 25:
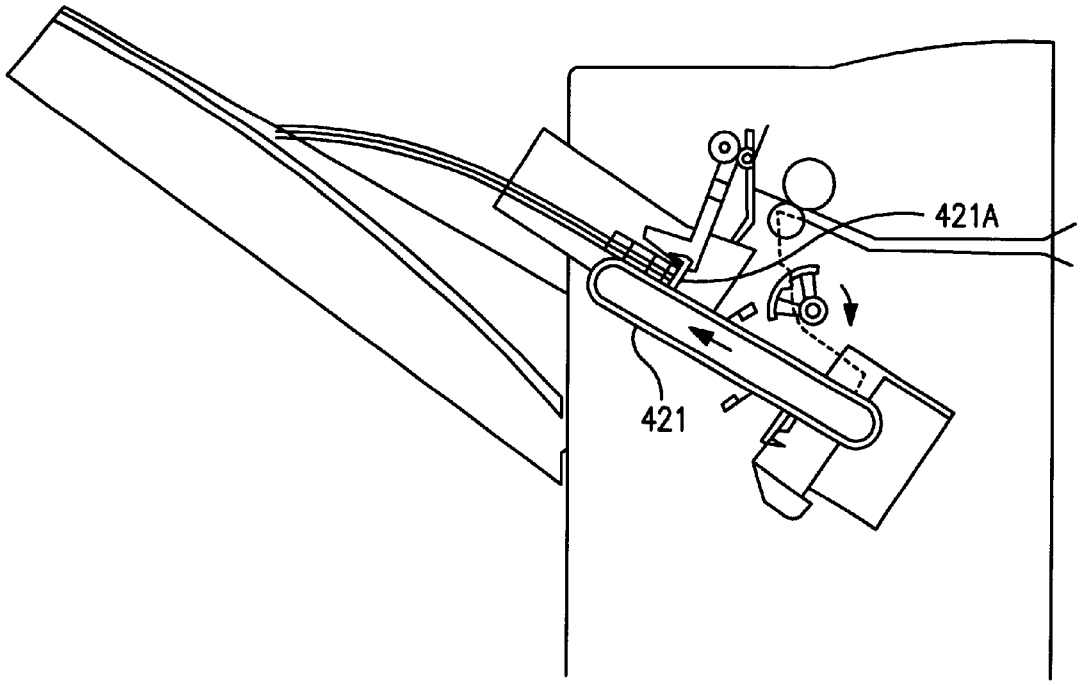
FIG. 25 shows sheets discharged by hook 421A.

Hook 421A is provided on belt 421 and discharges sheets stacked on belt 421 to tray 411 in a bundle when belt 421 rotates counterclockwise as shown in FIG. 25. A part of the process tray is cut out for preventing from interfering hook 421A. Tray 411 is referred as a stack tray. Tray 411 moves vertically in accordance with a number of sheet stacked on tray 411. Tray 411 moves down until the top of the stack of sheets on tray 411 locates below the bottom of stopper 420. Stopper 420 moves away from tray 411 when tray 411 moves down. Stopper 420 moves to the position shown in FIG. 5 when tray 411 moves up. Then tray 411 moves up until the top of the stack of sheets on tray 411 completely touches to stopper 420, thereby, the stack of sheets is pressed by stopper 420, and it is prevented that a succeeding stack drags the stack of sheets on tray 411.

Figure 6:
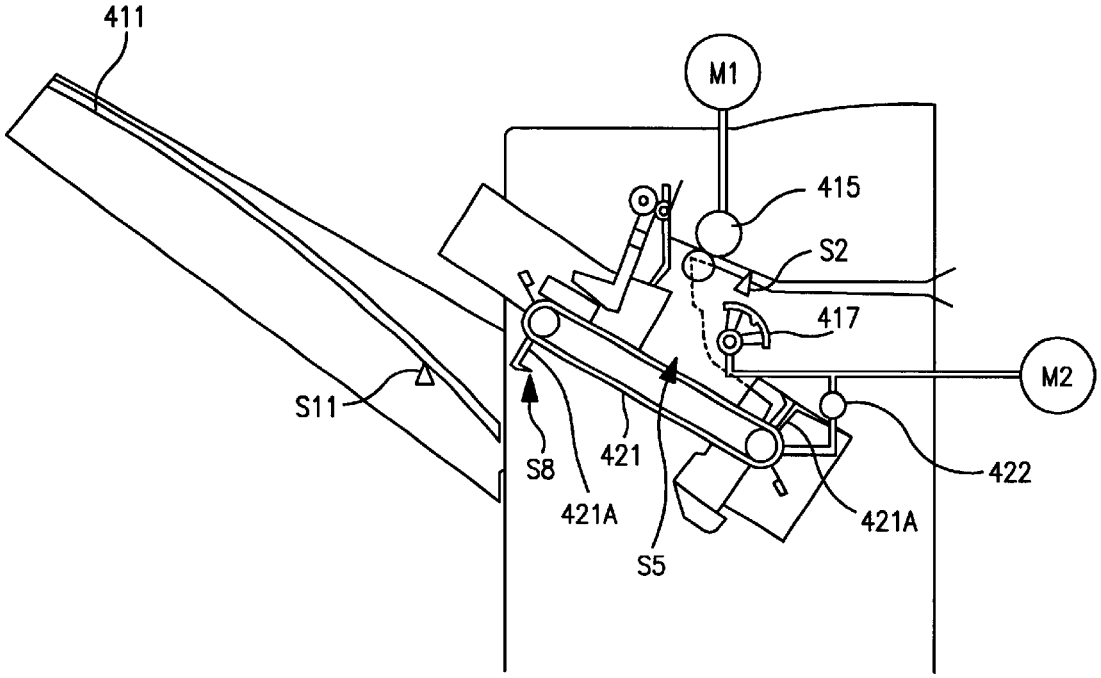
FIG. 6 shows sensors and motors in the sheet processing apparatus of FIG. 5.
Figure 7:
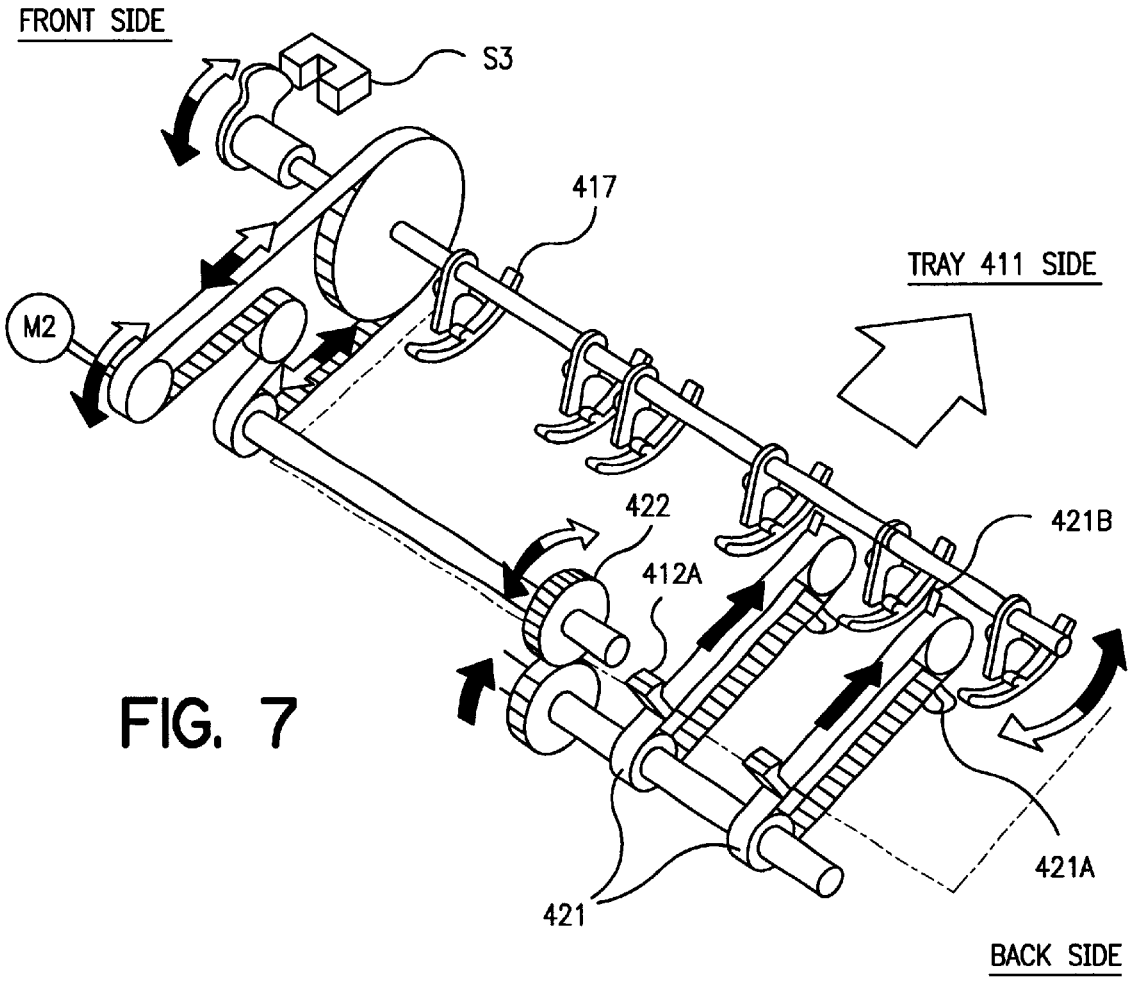
FIG. 7 shows a perspective illustration of roller 417 and belt 421.

FIG. 6 shows sensors and motors provided in sheet processing apparatus 400. Motor M1 drives roller 415. Motor M2 drives roller 417 and belt 421. Motor M2 drives belt 421 through one-way-clutch 422. One-way-clutch 422 does not transmit the driving force of motor M2 when motor M2 rotates reverse. Only roller 417 is driven by motor M2 and roller 417 rotates counterclockwise in FIG. 6 when motor M2 rotates in first direction. Roller 417 and belt 421 are driven and roller 417 rotates clockwise when motor M2 rotates in second direction which is opposite to the first direction. FIG. 7 shows a perspective illustration of roller 417 and belt 421. When motor M2 rotates in a direction shown in the solid black arrow, roller 417 and belt 421 rotate in a direction shown in the solid black arrows. When motor M2 rotates in directions shown in the outline arrow, roller 417 rotates in a direction shown in the outline arrow. This mechanism provides a low cost product.

Sensor S3 detects whether roller 417 is in a home position. Roller 415 is rotated in accordance with a leading edge of a sheet being detected by sensor S2. The speed of roller 415 is reduced at the timing which will be described later. Then the rotation of roller 415 is stopped. Sensor S5 detects a sheet on belt 421. Sensor S11 detects a sheet on tray 411. Sensor S8 detects whether hook 421A is in a home position. FIG. 6 shows the home positions of roller 417 and hook 421A.

Roller 417 rotates counterclockwise by one revolution from the home position for every discharge of a sheet. Belt 421 does not rotate when roller 417 rotates counterclockwise. The home position of hook 421A is on the right hand of stopper 418 for preventing that hook 421A interferes a sheet. When a stack of sheets on belt 417 is discharged, roller 417 is rotated clockwise by one and eighth part (1+⅛) revolution after roller 417 is rotated counterclockwise by eighth part revolution, thereby roller 417 does not contact with the stack of sheets on belt 421 and roller 417 follows after hook 421A. Therefore, roller 417 never interferes with the discharge of the stack of sheets. Belt 421 rotates counterclockwise by a half revolution when roller 417 rotates clockwise by one and eighth part revolution. Two hooks 421A are provided to belt at even intervals. Therefore, hook 421A is located at the home position after the other hook 421A is rotated by a half revolution.

Roller 417 rotates counterclockwise by one revolution when the discharge by hook 421A is not succeeding after the rotation of roller 417. Meanwhile, when the discharge by hook 421A is succeeding after the rotation of roller 417, roller 417 rotates counterclockwise by one and eighth part revolution without stopping at one revolution and then rotates clockwise as described above. With this arrangement, a process time, in a case where the stack of sheet is discharged, is shortened.

Figure 8:
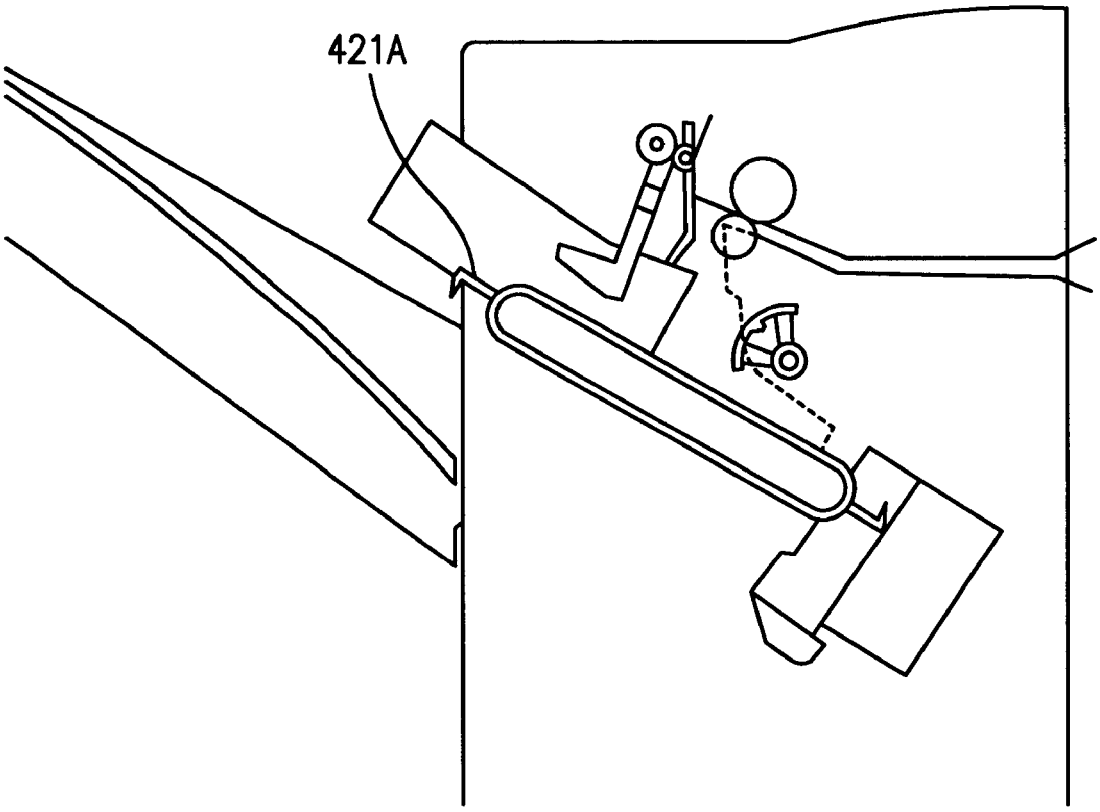
FIG. 8 shows a stop position of hook 421.

By the time a stack of sheets on belt 421 is discharged, tray 411 is moved to a position in which the distance between belt 421 and the top of the stack of sheets on tray 411 is suitable for stacking the stack of sheets discharged from belt 421. However, the top of stack of sheets is on a track of hook 421A. Therefore, belt 421 rotates until hook 421A is parallel with a straight part of belt 421 as shown in FIG. 8, and then the rotation of belt 421 is stopped by stopping motor M2. Then, tray 411 moves down until the top of stack of sheets on tray 411 locates below the bottom of stopper 420. Belt 421 starts to rotate when the top of stack of sheets moves away from the track of hook 421A. Then belt 421 stops when hook 421A locates at the home position. Since belt 421 stops temporally when hook 421A becomes parallel with the straight part of belt 421, hook 421A does not catch the sheet on tray 411 and the trailing edge of the discharged sheets do not remain on belt 421. This process corresponds to a movement of motor M2 during time periods "*17" and "*18" in FIGS. 11 and 12. Roller 417 rotates counterclockwise by one and eighth part revolution during time period "*16" in FIGS. 11 and 12. Then, roller 417 rotates clockwise by one and eighth part revolution and belt 421 rotates by revolution during time periods "*17" and "*18" in FIGS. 11 and 12.

Figure 9:
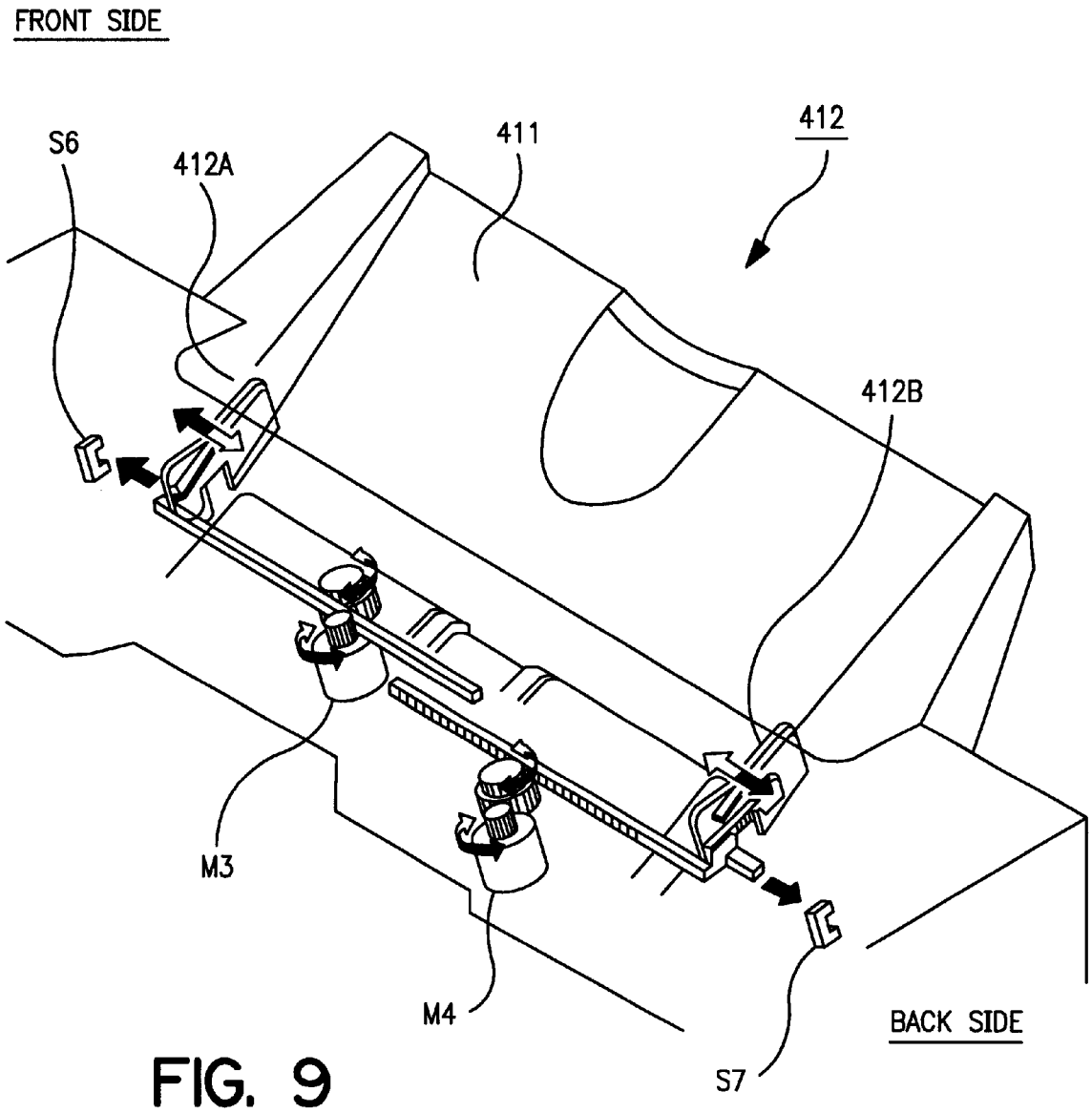
FIG. 9 shows a perspective illustration of jogger 412.

FIG. 9 shows a perspective illustration of jogger 412. Jogger 412A is provided on the front side and jogger 412B is provided on the back side. Motor M3 drives jogger 412A and motor M4 drives jogger 412B. The jogger moves in a direction shown by an arrow when the motor moves in a direction shown by the same arrow. Sensor S6 is provided for detecting a home position of jogger 412A and sensor S7 is provided for detecting a home position of jogger 412B. In a case where a stack of sheets is stapled by stapler 419, jogger 412A jogs a sheet to jogger 412B for each discharging the sheet to belt 421 in a state where jogger 412B locates on the most back side. In a case where the staple process is not done, a jogging position is changed for each discharge of the sheets. For example, the first stack is jogged to the back side, and then the second stack is jogged to the front side, and then the third stack is jogged to the back side, thereby, the stacks of sheets are sifted with respect to each stack. When a stack is jogged to the back side, jogger 412B is set at the most back side, and then jogger 412A jogs a sheet to jogger 412B for each discharging the sheet to belt 421. When a stack is jogged to the front side, jogger 412A is set at the most front side, and then jogger 412B jogs a sheet to jogger 412A for each discharging the sheet to belt 421. Therefore, the sheets are stacked on tray 411 in a state where the stacks are sifted with respect to each other as shown in FIG. 24.

A driving timings of jogger 412 and roller 417 will be described hereinafter. As described above, roller 417 moves a sheet in a direction perpendicular to a direction in which jogger 412 moves the sheet. If roller 417 and jogger 412 move the sheet at the same time, the sheet is not moved correctly and the sheet get wrinkled. Therefore, after roller 417 moves the sheet, jogger 412 moves the sheet, thereby, preventing that jogger 412 moves the sheet in a state where roller 417 contacts with the sheet. That is, after motor M2 drives roller 417 during time period "*16" in FIGS. 11 and 12, motor M4 drives jogger 412B during time period "*14" in FIGS. 11 and 12.

Figure 10:
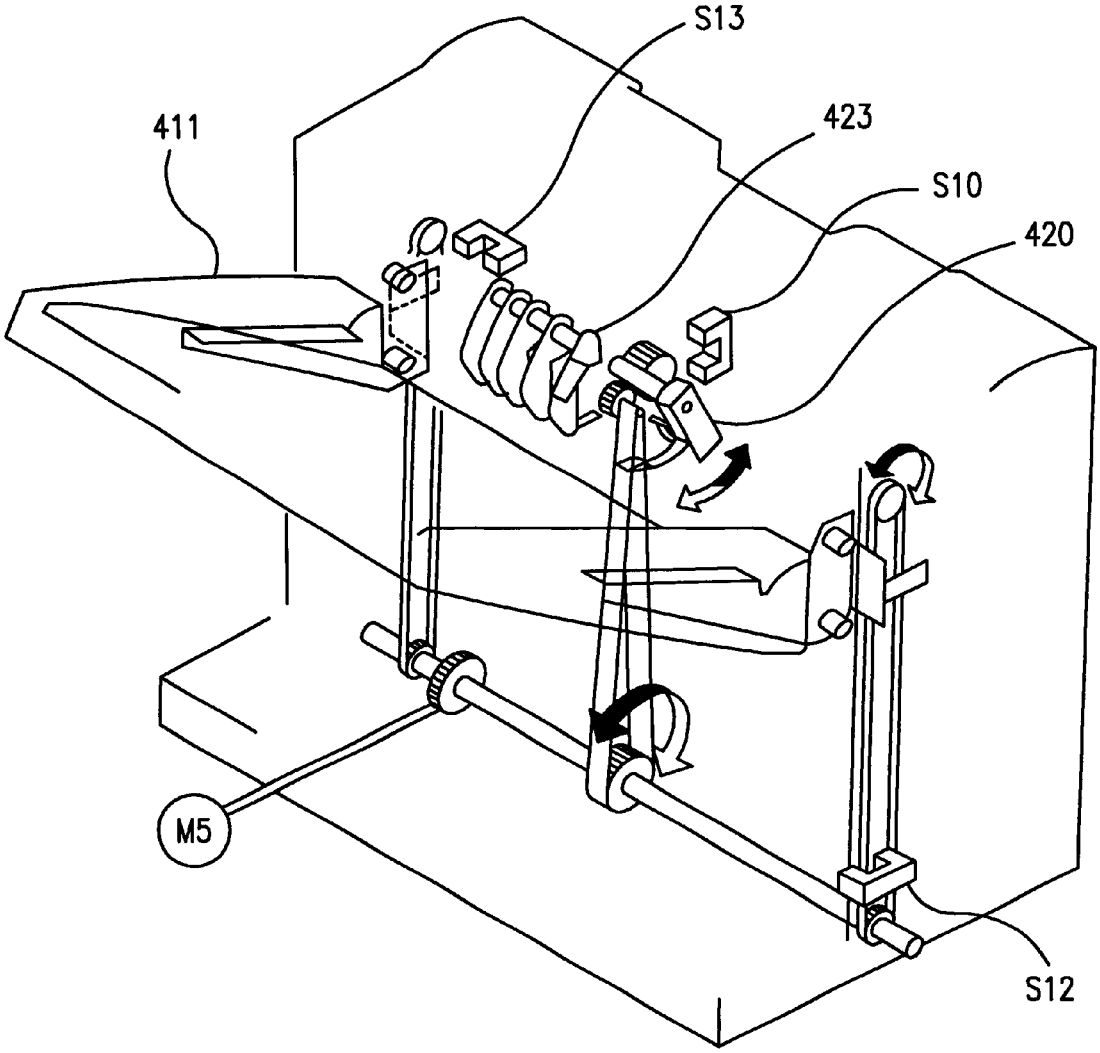
FIG. 10 shows a mechanism of moving tray 411.

FIG. 10 shows a mechanism of moving tray 411. Motor M5 drives tray 411 and stopper 420. Sensor S13 detects that tray 411 reaches an upper limit. Sensor S12 detects that tray 411 reaches a lower limit. Flag 423 is for detecting the top of the stack of sheets on tray 411. When the top of the stack of sheets locates above stopper 420, flag 423 is pushed by the stack of sheets, and sensor S10 detects flag 423 pushed. Tray 411 moves down until flag 423 returns, that is, the stack locates below stopper 420. When tray 411 moves down, stopper 420 moves away from tray 411 as shown in solid black arrows, thereby preventing stopper 420 interfering that the stack of sheets moves down. When the top of the stack locates below stopper 420, tray 411 changes to move up. When tray 411 moves up, stopper 420 moves to above tray 411 as shown in outline arrows, thereby stopper 420 fixes the sheets on tray 411.

Figure 11:
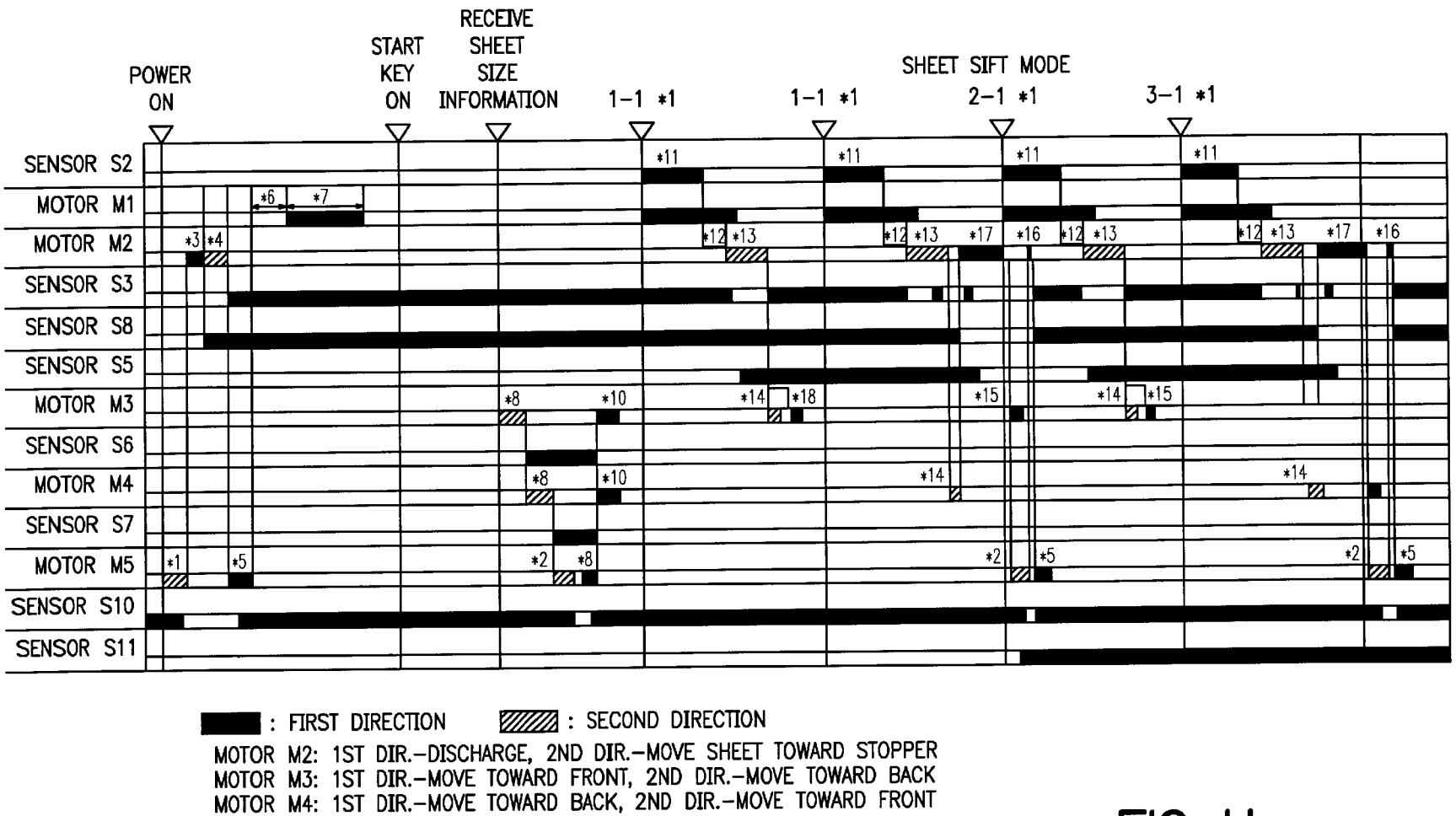
FIG. 11 shows a timing chart of the sheet processing apparatus.
Figure 12:
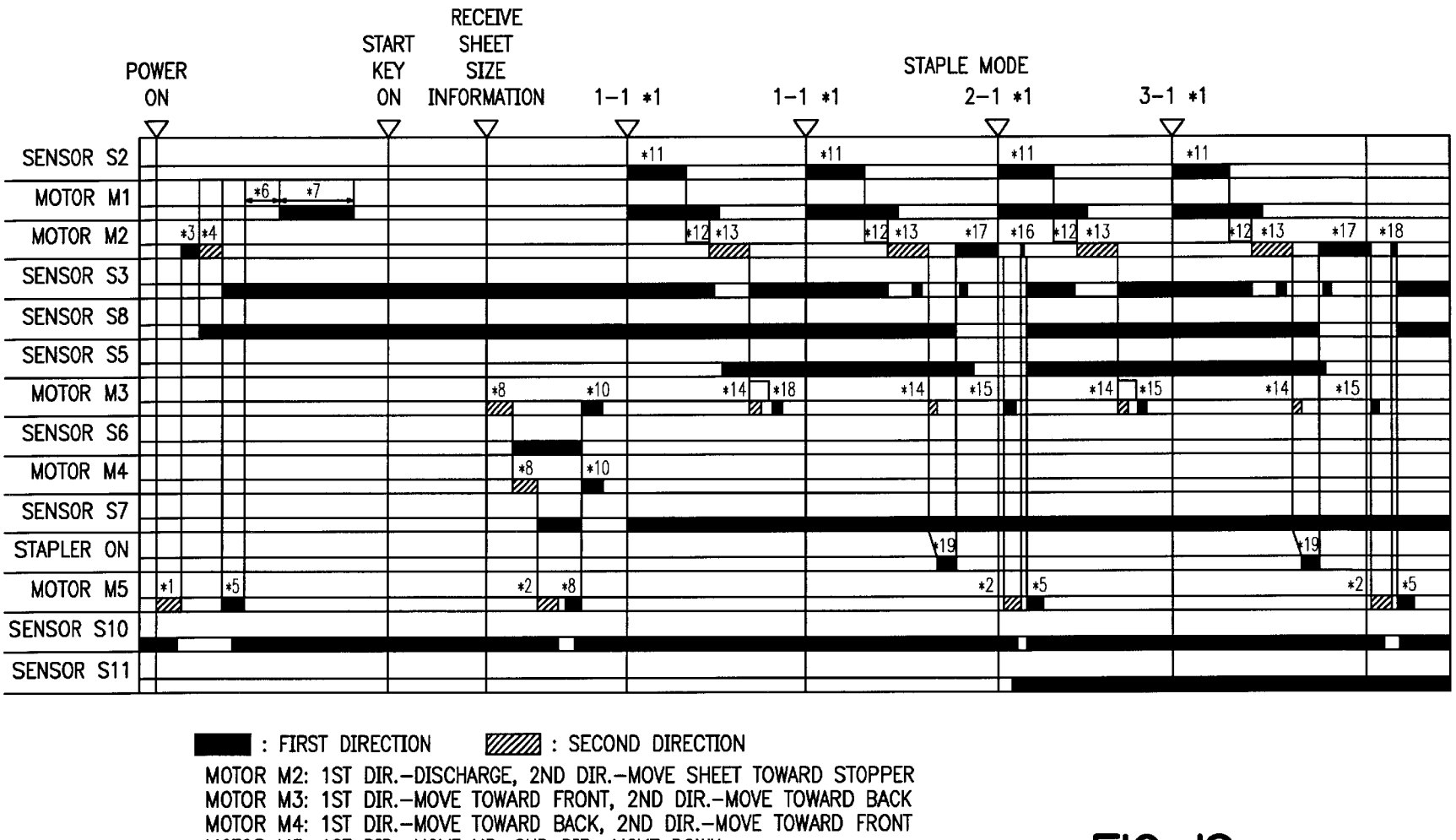
FIG. 12 shows a timing chart of the sheet processing apparatus.

FIG. 11 shows a timing chart in a case where the image forming apparatus makes two copies of two documents and sheet processing apparatus 400 does not staple sheets and shifts stacks of the sheets on tray 411 with respect to each other. FIG. 12 shows a timing chart in a case where the image forming apparatus makes two copies of two documents and sheet processing apparatus 400 staples sheets and does not shift the stacks of sheets on tray 411. Black bands in these figures for motors indicate a rotation in a first direction. Slant stripe bands indicate a rotation in a second direction. Black bands in figures for sensors indicate a state in which the sensor detects a predetermined object.

During time period "*1", "1-1" means the first copy of the first page, "1-2" means the first copy of the second page, "2-1", means the second copy of the first page, "2-2" means the second copy of the second page. During time period "*2", motor M5 rotates in the second direction until sensor S10 becomes OFF, that is, tray 411 moves down until flag 423 returns. During time period "*3", motor M2 rotates in the first direction until sensor S8 becomes ON, that is, belt 421 rotates until hook 421A locates the home position. During time period "*4", motor M2 rotates in the second direction until sensor S3 becomes ON, that is, roller 417 rotates until roller 417 locates the home position. During time period "*5", motor M5 rotates in the first direction until sensor S10 becomes ON, that is, tray 411 moves up until stopper 420 fixes the top of the stack of sheets on tray 411. Motor M1 rotates during time period "*7" after time period "*6". During time period "*8", motor M3 rotates the second direction until sensor S6 becomes ON, that is, jogger 412A moves to the front side. During time period "*9", motor M4 rotates the second direction until sensor S7, that is, jogger 412B moves to the back side. During time period "*10", motors M3 and M4 rotates until jogger 412A and 412B locate home positions. During time periods "*14", and "*15", motor M3 rotates in the second direction and then rotates in the first direction, thereby, jogger 412A jogs a sheet on belt 421. During time period "*13", motor M3 rotates in the second direction for rotating roller 417 by one revolution. During time period "*16", motor M3 rotates in the second direction for rotating roller 417 by one and eighth part revolution. During time period "*17", motor M2 rotates in the first direction for rotating belt 421, thereby, a stack of sheets is discharged to tray 411. During a period between "*17" and "*18", motor M2 stops temporarily in the state shown in FIG. 8. During time period "*18", motor M2 rotates in the first direction until hook 421A locates the home position. During time period "*19", stapler 419 staples sheets after a predetermined time elapsed from roller 417 stopped.

Figure 13:
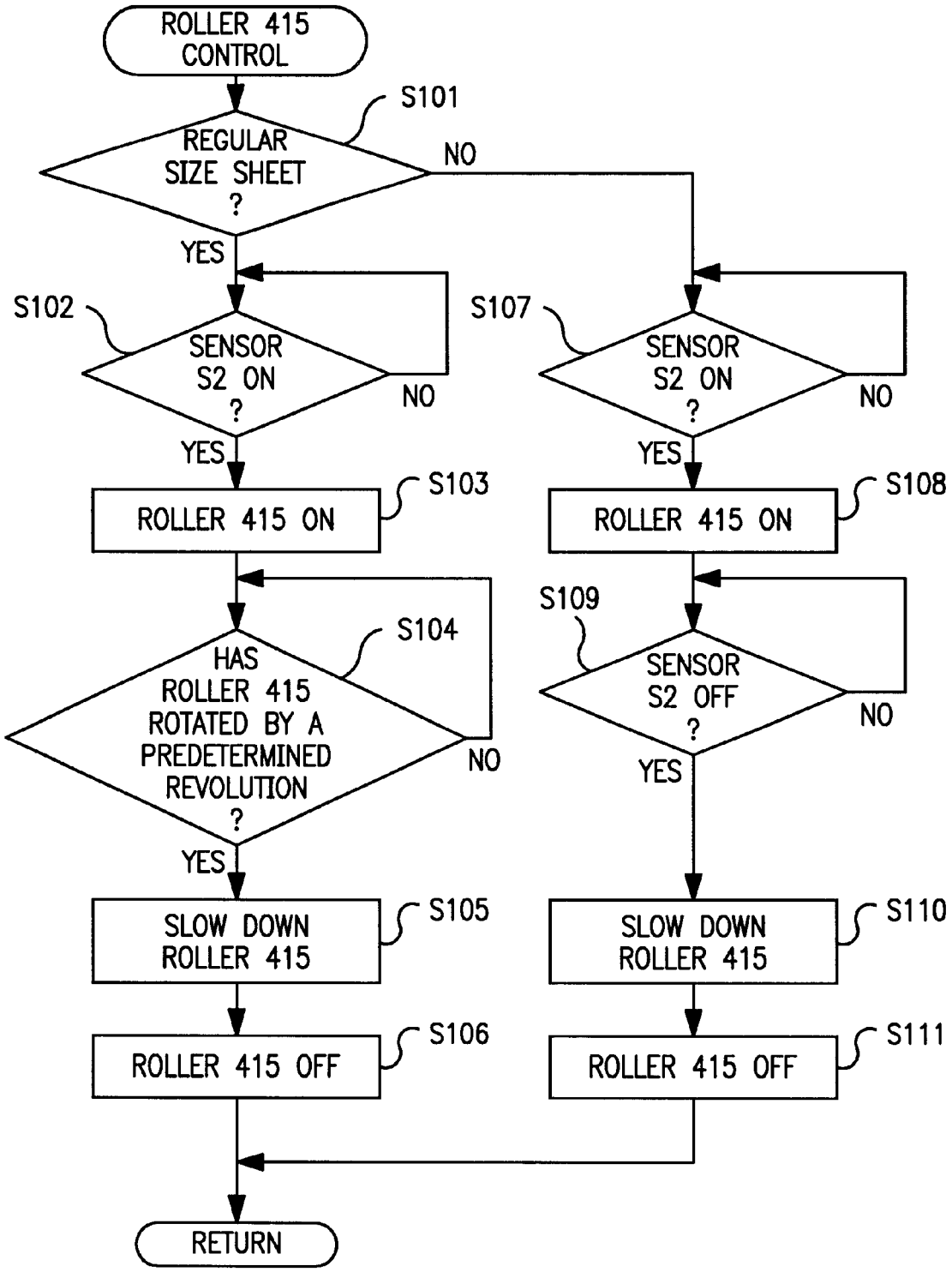
FIG. 13 shows a flowchart for controlling roller 415.

FIG. 13 shows a flowchart for controlling roller 415 of sheet processing apparatus 400. Before this flowchart is described, a condition of roller 415 will be explained. Roller 415 rotates in a high speed (a first speed) when roller 415 transports a sheet, but rotates in a low speed (a second speed) when the trailing edge of the sheet leaves from roller 415. Thereby, it is prevented that the leading edge of the sheet hangs while the sheet is transported and it is prevented that the sheet jumps over belt 421 after leaving roller 415. Since sheet processing apparatus 400 is designed to be small, sensor S2 is close to roller 415. Sensor S2 detects a sheet for detecting a sheet jam in path 416 and for changing a speed of roller 415 from the first speed to the second speed. No sensor is provided on path 416 besides sensor S2.

Returning to FIG. 13, sheet processing apparatus 400 (sheet processing apparatus controller 401) receives size information of a sheet from the image forming apparatus (CPU circuit unit 150) for each discharge of a sheet. Controller 401 discriminates if a sheet size to be transported by roller 415 is one of regular sizes (S101). If it is a regular size, after sensor S2 becomes ON, that is, after the leading edge of the sheet passes sensor S2 (S102), controller 401 controls motor M1 to rotate in order to rotate roller 415 (S103). Controller 401 discriminates if roller 415 has rotated by a predetermined revolution according to the sheet size (S104). Since motor M1 is a stepping motor, controller 401 knows how much motor M1 rotates. Controller 401 controls motor M1 to slow down after roller 415 has rotated by the predetermined revolution (S105), and then controls motor M1 to stop (S106). The predetermined revolution is designed for each sheet size so that roller 415 stops right after the trailing edge of the sheet leaves from roller 415.

Meanwhile, if the sheet size is not one of the regular sizes at step S101, after sensor S2 becomes ON, that is, after the leading edge of the sheet passes sensor S2 (S107), controller 401 controls motor M1 to rotate in order to rotate roller 415 (S108). Then, right after sensor S2 becomes OFF, that is, right after the trailing edge of the sheet passes sensor S2 (S109), controller 401 controls motor M1 to slow down (S110), and then controls motor M1 to stop (S111).

Since sensor S2 is close to roller 415, it is better to slow down roller 415 in accordance with the detection of the leading edge of the sheet and the size information than in accordance with a detection of the trailing edge of the sheet. This is because the timing of slowing down is not delayed when roller 415 is slowed down in accordance with the detection of the leading edge of the sheet and the size information. However, the image forming apparatus does not send a length of a sheet to sheet processing apparatus 400, but sends a sheet size code. When the sheet size is not regular size, the image forming apparatus sends information indicating that the size is not regular size. That is, sheet processing apparatus 400 can not discriminate the sheet size when the sheet is not one of the regular sizes. Therefore, roller 415 is slowed down in accordance with the detection of the trailing edge of the sheet. Even if the timing of slowing down is delayed by slowing down in accordance with the detection of the trailing edge of the sheet, the sheet does not jump over belt 421.

Figure 14:
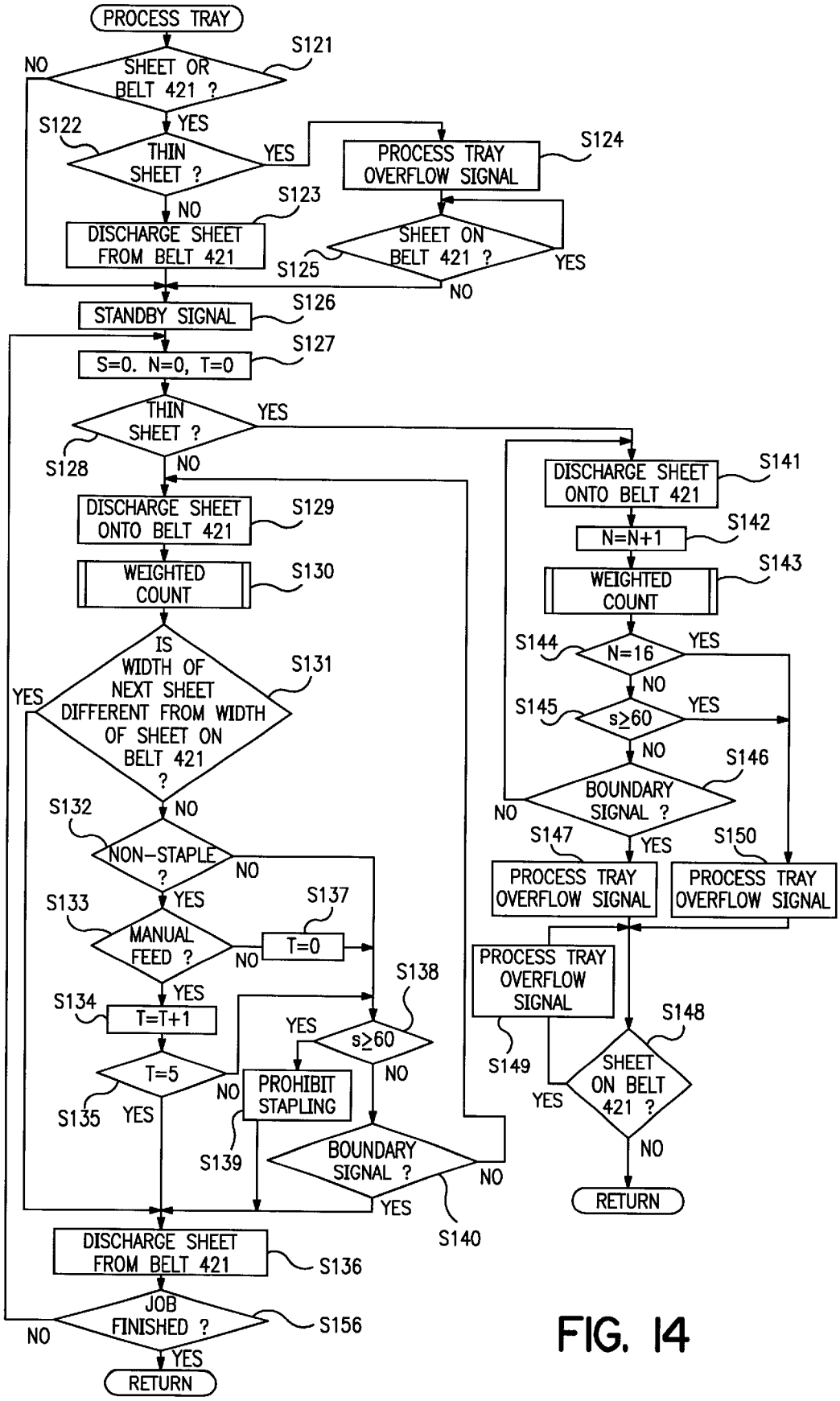
FIG. 14 shows a flowchart of controlling belt 421.
Figure 15A:
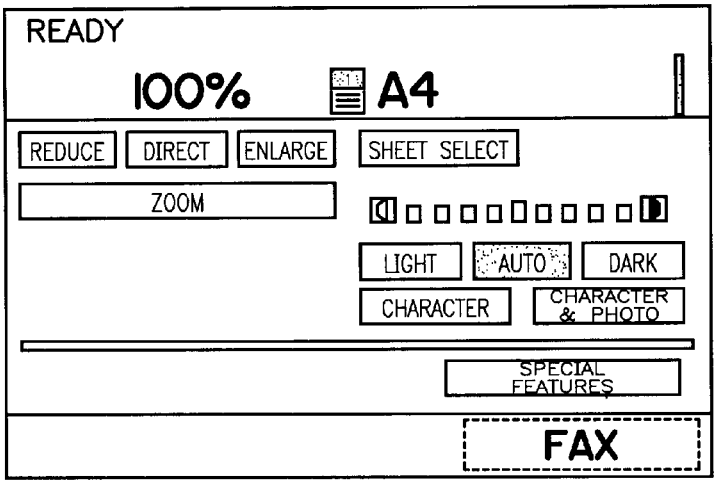
FIGS. 15(*a*) through 15(*c*) show screens of an operation panel of the image forming apparatus.
Figure 15B:
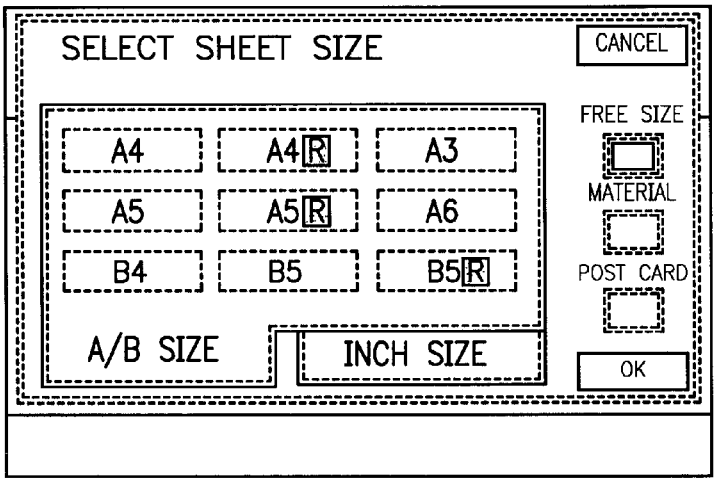
Figure 15C:
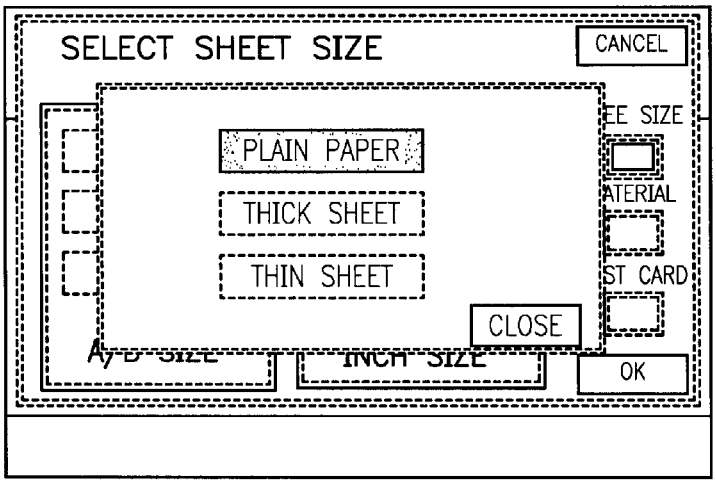

FIG. 14 shows a flowchart of controlling belt 421. Controller 401 discriminates if there is a sheet on belt 421 in accordance with a detection result of sensor S5 (S121). If there is a sheet on belt 421, controller 401 discriminates if the sheet is a thin sheet having a weak stiffness (S122). One example of a thin sheet is called a "second master drawing" and is used for drafting. When manual feeding unit 125 usage is designated on the operation panel of the image forming apparatus, the operation panel displays the screen shown in FIG. 15(*b*). The operation panel displays the screen shown in FIG. 15(*c*) in accordance with the "Material" key being touched. The image forming apparatus sends material information and sheet feeding unit information for each sheet in accordance with the thin sheet key being touched. Thereby, sheet processing apparatus 400 discriminates if a sheet discharged on belt 421 is the thin sheet. FIG. 15(*a*) shows a screen in a ready state of a copy mode. The display of FIG. 15(*b*) is obtained by pressing the "OK" key.

If the sheet is not a thin sheet at step S122, controller 401 controls belt 421 to rotate for discharging a stack of sheets on belt 421 (S123), and then outputs a standby signal to the image forming apparatus (S126). If the sheet is a thin sheet at step S122, controller 401 outputs a process tray overflow signal to the image forming apparatus (S124). The operation panel of the image forming apparatus displays an instruction such as "please remove sheets from process tray" when the image forming apparatus receives the process tray overflow signal. After controller 401 waits for the sheets being removed (S125), controller 401 outputs the standby signal to the image forming apparatus (S126). If there is not a sheet on belt 421 at step S121, controller 401 outputs the standby signal to the image forming apparatus (S126). The image forming apparatus starts an image formation in accordance with the standby signal from sheet processing apparatus 400.

After step S126, controller 401 sets 0 in variables S, N and T (S127). Variables S and N are used for preventing over-stacking on the process tray. Variable T is used for preventing an adverse effect by a static charged on a transparent sheet for an overhead projector when the transparent sheet is processed by sheet processing apparatus 400. Controller 401 receives material information of a sheet from the image forming apparatus and discriminates if the sheet is a thin sheet (S128).

If the sheet is not a thin sheet at step S128, after a sheet is discharged onto belt 421 (S129), controller 401 does a weighted count which is described later (S130). Controller 401 receives sheet size information of a coming sheet from the image forming apparatus and discriminates if a width of the coming sheet is different from a width of sheets stacked on belt 421 (S131). If those widths are not different, controller 401 discriminates if the designation for the coming sheet includes a non-staple mode (S132). If the designation includes the non-staple mode, controller 401 discriminates if the coming sheet is from manual feeding unit 125 (S133). If the coming sheet is from manual feeding unit 125, controller 401 adds 1 to variable T (S134), and discriminates if variable T is 5 (S135). If variable T is 5, that is, 5 sheets are continuously fed from manual feeding unit 125, controller 401 controls belt 421 to discharge the sheets on belt 421 (S136). Then, if the job is not finished (S156), controller 401 returns to step S127. If the sheet is not from manual feeding unit 125 at step S133, controller 401 sets 0 in variable T (S137) and advances to step S138. If variable T is not 5 at step S135, controller 401 advances to step S138.

Manual feeding unit 125 is designed for feeding various kinds of sheets including a transparent sheet for an overhead projector. The transparent sheet tends to be charged by static. In a case where at most 30 sheets are discharged from belt 421 to tray 411, the sheets do not have adverse effects on sheets which have been stacked on tray 411. However, in a case where more than 30 transparent sheets are discharged from belt 421 to tray 411, the sheets may drag sheets which have been stacked on tray 411 because of the weight and the static of the transparent sheets. Therefore, belt 421 discharges sheets after 5 sheets are continuously fed from manual feeding unit 125 which feeds a sheet including a transparent sheet in order to prevent dragging sheets on tray 411.

If the width of the coming sheet is different from the width of sheets stacked on belt 421 at step S131, controller 401 advances to step S136 for discharging the sheets on belt 421. If the designation does not include the non-staple mode at step S132, that is, it the designation includes a staple mode, controller 401 discriminates if variable S is 60 or more (S138). If variable S is less than 60, controller 401 discriminates if a boundary signal between jobs is outputted from the image forming apparatus (S140). If the boundary signal is not outputted, controller 401 returns to step S129. If the boundary signal is outputted, controller 401 advances to step S136 for discharging the sheets on belt 421. If variable is 60 or more at step S138, controller 401 prohibits stapling although the designation includes the staple mode (S139) and advances to step S136 for discharging the sheets on belt 421.

If the sheet is a thin sheet at step S128, after a sheet is discharged onto belt 421 (S141), controller 401 increments variable N (S142). Controller does a weighted count which is described later (S143), and then discriminates if variable N is 15 (S144). If variable N is not 15, controller 401 discriminates if variable S is 60 or more (S145). If variable is less than 60, controller 401 discriminates whether the boundary signal between jobs is outputted from the image forming apparatus (S146). If the boundary signal is not outputted, controller 401 returns to step S141. If the boundary signal is outputted, controller 401 outputs the process tray overflow signal to the image forming apparatus (S147) for displaying the instruction described hereinbefore.

Since the thin sheet has a weak stiffness, the thin sheet is not suited to be discharged by hook 421A. Therefore, belt 421 does not discharge the thin sheet, and a user picks up the thin sheet from belt 421. The process tray overflow signal is outputted to the image forming apparatus for activating the display of the instruction for the user. After step S147, until the sheets are picked up (S148), controller keeps outputting the process tray overflow signal to the image forming apparatus (S149). The image forming apparatus does not start a next image formation job during receiving the process tray overflow signal.

If variable N is 15 at step S144, or if variable S is 60 or more at step S145, controller 401 outputs the process tray overflow signal to the image forming apparatus (S150) and advances to S148. The image forming apparatus displays the instruction described hereinbefore while the process tray overflow signal is outputted.

Figure 26:
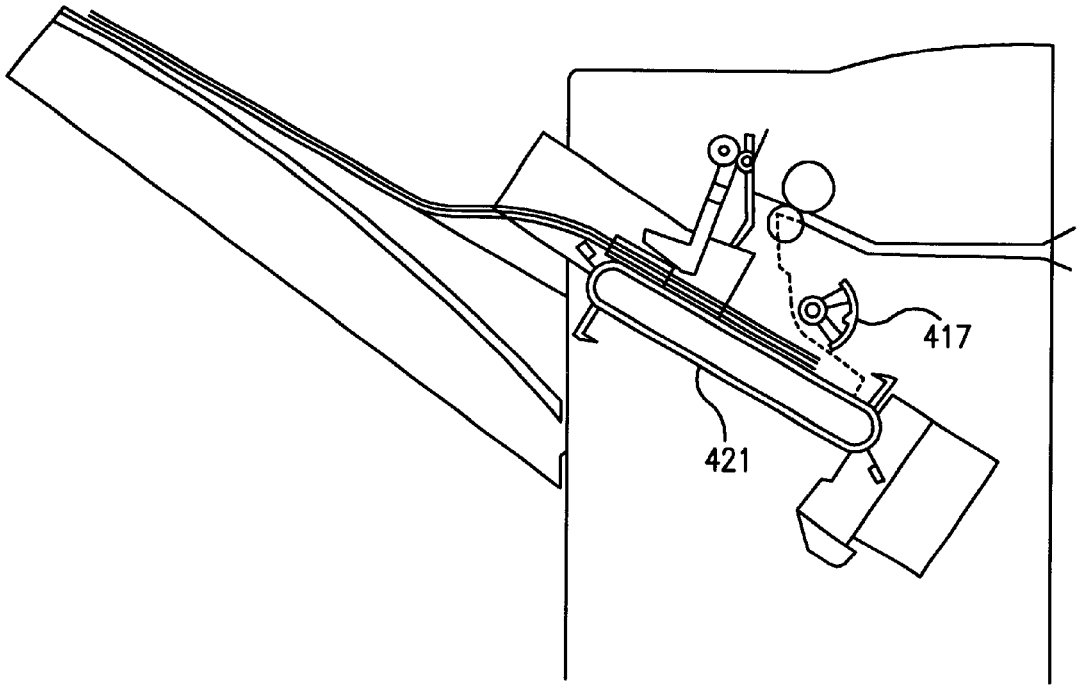
FIG. 26 shows thin sheets discharged onto belt 421.

In a case where controller 401 advances to S129, that is, in a case where a sheet other than a thin sheet is discharged, jogger 412 jogs the sheet in accordance with the size of the sheet and roller 417 rotates counterclockwise. On the other hand, in a case where controller 401 advances to S141, that is, in a case where a thin sheet is discharged, jogger 412 waits at a position where it does not interfere with the discharged sheet and does not jog the sheet, and roller 417 does not rotate. FIG. 26 shows a situation where the thin sheet is discharged onto belt 421.

Figure 16:
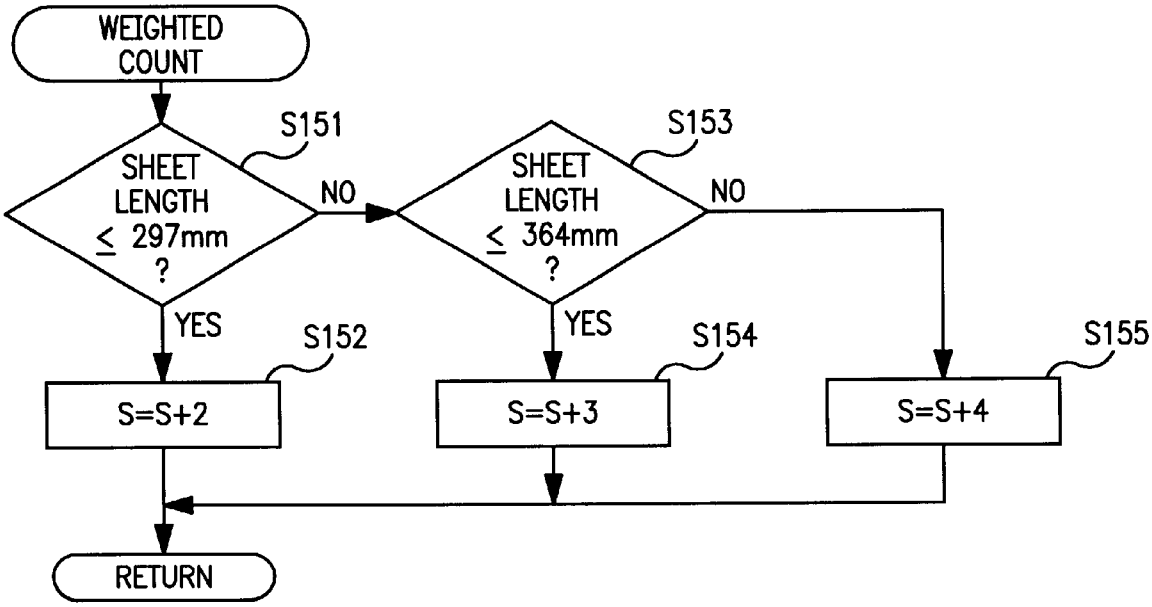
FIG. 16 shows a flowchart of a weighted count at step S130 and S143.

FIG. 16 shows a flowchart of the weighted count at step S130 and S143. Controller 401 discriminates a length of a sheet in accordance with sheet size information received from the image forming apparatus. If the length is 297 mm or less (Sl51), controller 401 adds 2 to variable S (S152). If the length is 364 mm or less and is longer than 297 mm (S153), controller 401 adds 3 to variable S (S154). If the length is longer than 364 mm, controller 401 adds 4 to variable S (S155). By doing the weighted count in accordance with a length of a sheet, a number of sheets is controlled so as to be suitable for being discharged by belt 421.

Figure 17:
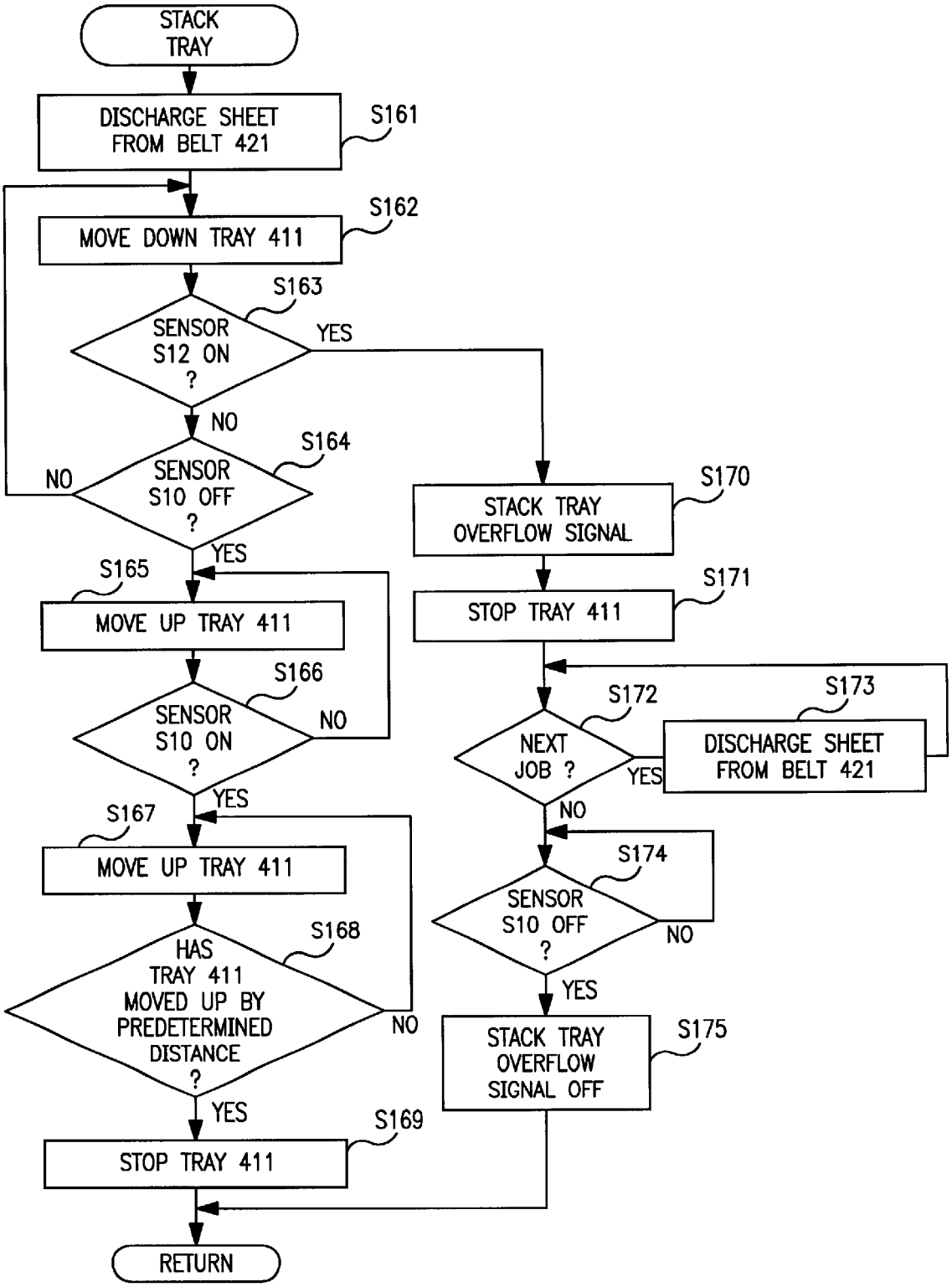
FIG. 17 shows a flowchart for controlling tray 411.
Figure 18:
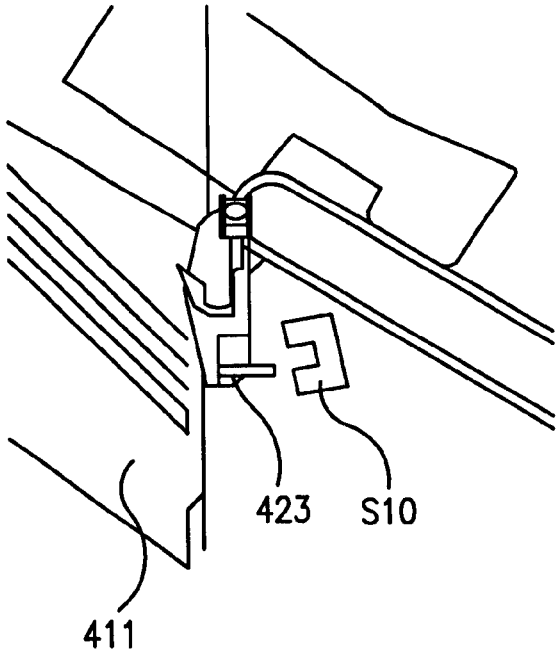
FIG. 18 shows flag 423 and sensor S10.
Figure 19:
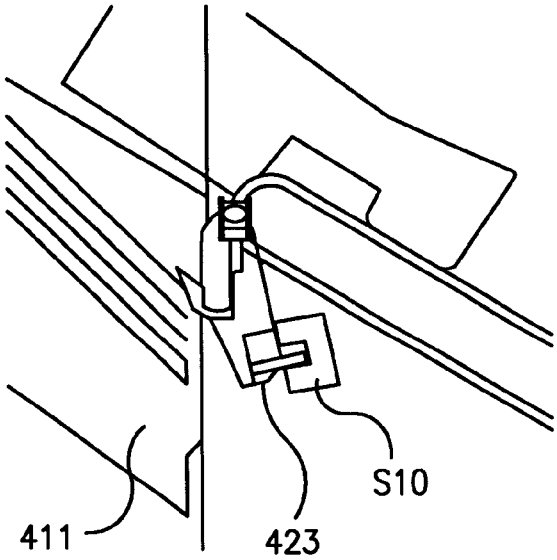
FIG. 19 shows flag 423 and sensor S10.

FIG. 17 shows a flowchart for controlling tray 411. Controller 401 controls tray 411 to move to a position where sensor S10 becomes ON after a power is applied as shown in FIGS. 11 and 12. After a stack of sheets is discharged from belt 421 (S161), controller 401 controls tray 411 to move down (S162) and discriminates if tray 411 reaches to a lower limit based on a detection result of sensor S12 (see FIG. 10) (S163). If tray 411 does not reach to the lower limit, that is, if sensor S12 is not ON, controller 401 discriminates if sensor S10 is OFF (see FIG. 18) (S164). If sensor S10 is not OFF, controller 401 returns to step S162. If sensor S10 is OFF at step S164, controller 401 controls tray 411 to move up until sensor S10 becomes ON (see FIG. 19) (S165, S166). Furthermore, controller 401 controls tray 411 to move up by a predetermined distance after sensor S10 becomes ON (S167, S168) and controls tray 411 to stop (S169). Tray 411 is moved by DC motor (motor M5). An encoder pulse is generated from an encoder which is provided on a shaft of motor M5. Controller 401 discriminates the position of tray 411 based on the encoder pulse from the encoder.

If tray 411 reaches to the lower limit at step S163, that is, if sensor S12 becomes ON, controller 401 outputs a stack tray overflow signal to the image forming apparatus (S170) and controls tray to stop (S171). The operation panel of the image forming apparatus displays an instruction such as "please remove sheets from stack tray" when the image forming apparatus receives the stack tray overflow signal. Then, controller 401 discriminates if there is a next job in which sheets are discharged by belt 421 (S172). If there is the next job, controller 401 controls belt 421 to discharge sheets (S173). If there is no job, controller 401 waits for sensor S10 becoming OFF (S174). If sensor S10 becomes OFF, controller 401 stops outputting the stack tray overflow signal (S175). In a case where tray 411 reaches the lower limit during tray 411 moves down, controller 401 does not control to move up tray 411, and controls belt 421 to discharge sheets corresponding to jobs in which the image forming apparatus can not stop the jobs such as a job received from computer 204 at the time tray 411 reaches to the lower limit.

Figure 27:
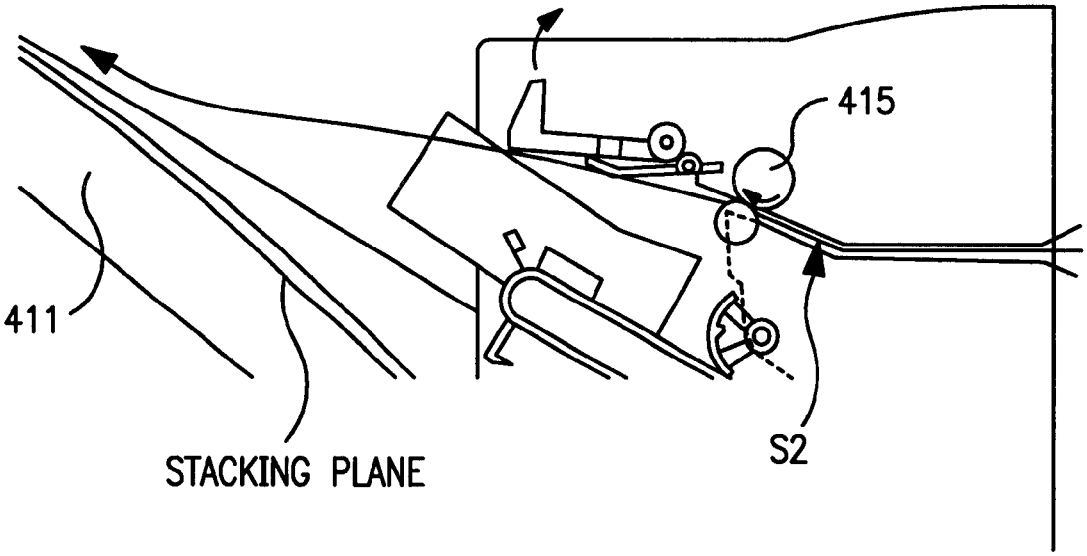
FIG. 27 shows a sheet discharged by roller 415.

A position of tray 411 will be described hereinafter. If tray 411 is too far from belt 421, a stack of sheets is not stacked on tray 411 in a good condition. A sheet is discharged by roller 415 as shown in FIG. 27. If tray 411 is too close to belt 421, the leading edge of the sheet bumps into a steeply slanting part of tray 411. There is a possibility of a jam during sheet discharge by roller 415 when tray 411 is too close to belt 421. The process in steps S162 through S169 makes a preferable distance between tray 411 and belt 421.

Since a top of a stack of sheets on tray 411 is detected by sensor S10, when the top of the stack is not detected until tray 411 reaches the lower limit, controller 401 can not discriminate the position of the top of the stack. Therefore, when tray 411 reaches to the lower limit during tray 411 moves down, tray 411 stays the lower limit by doing steps S170 through S173. In this case, there is a possibility in which the top of the stack on tray 411 is far from belt 421, but the top of the stack on tray 411 is not close to belt 421. Although sheets are not stacked on tray 411 in a good condition, since the sheets would be the last stack, there is no problem. Furthermore, a jam is prevented during roller 415 discharges a sheet.

Figure 28:
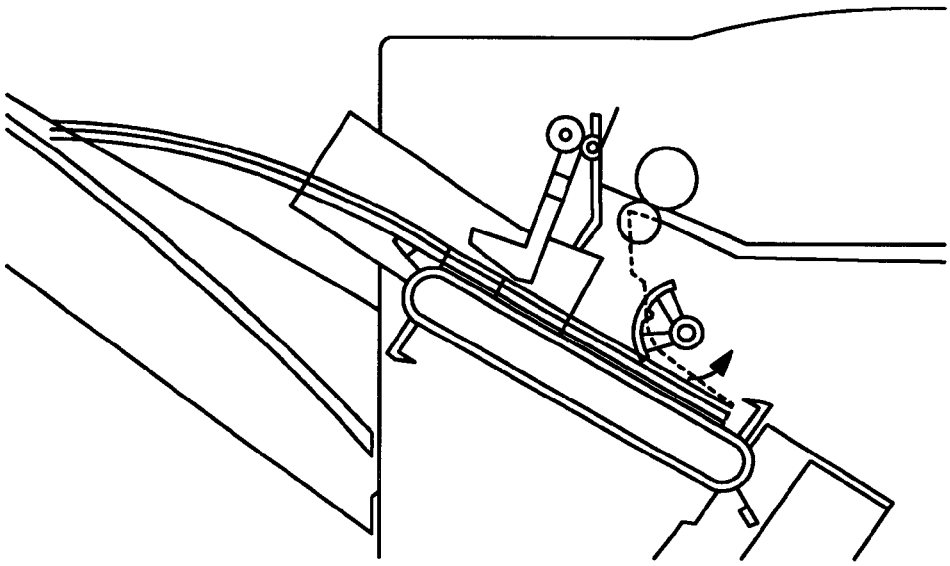
FIG. 28 shows sheets stacked on belt 421.

Belt 421 is designed to be relatively short for providing compact and low cost. When a long sheet such as A4R sheet and A3 sheet is stacked on belt 421, belt 421 can not hold the whole of the sheet. In this situation, the rest of the sheet is held by tray 411 (see FIG. 28). The position of tray 411 is controlled for holding the rest of the sheet.

When the image forming apparatus starts an image formation job in the staple mode, the operation panel of the image forming apparatus displays "please remove sheets from stack tray" in accordance with sheets on tray 411 being detected. In a case where stapled sheets are stacked on tray 411, the stacks of the stapled sheets are unbalanced, because staples concentrate on one position. Therefore, the image forming apparatus displays the above-noted instruction. However, the image forming apparatus does not wait for the stack being removed, because, there is a situation where a user is not by the image forming apparatus such as a print mode. On the other hand, when the image forming apparatus starts an image formation job in other mode other than the staple mode, even if sheets on tray 411 being detected, the image forming apparatus starts the image formation without displaying the massage.

After the image forming apparatus makes 30 stacks of sheets (30 copy sets) continuously, the image forming apparatus stops thoe image formation and displays "please remove sheets from stack tray" on the operation panel. Then the image forming apparatus waits for the sheets being removed, that is, waits for sensor S11 becoming OFF. After the sheets are removed from tray 411, the image forming apparatus starts the image formation again.

It is to be understood that the phraseology or terminology employed herein in for the purpose of description and not of limitation.

While the invention has been described with reference to the structures disclosed herein, it is not confined to the details set forth and this application is intended to cover such modifications or changes as may come within the purposes of the improvements or the scope of the following claims.

What is claimed is:

1. Sheet processing apparatus comprising:

a first tray for stacking sheets transported from an upstream;

a discharge unit for discharging the sheets from said first tray in a bundle;

a second tray for stacking the sheets discharged from said first tray;

a discriminating unit for discriminating a material of a sheet to be stacked on said first tray; and a controller for selectively controlling whether or not said discharge unit discharges in accordance with a discrimination of said discriminating unit.

2. Sheet processing apparatus according to claim 1, wherein said discriminating unit discriminates if the sheet is a thin sheet, and wherein said controller controls said discharge unit not to discharge the sheets when the sheet is a thin sheet and to discharge the sheets when the sheet is not a thin sheet.

3. Sheet processing apparatus according to claim 2, wherein said sheet processing apparatus receives a sheet from an image forming apparatus, and wherein said discriminating unit discriminates the material based on information received from the image forming apparatus.

4. Sheet processing apparatus according to claim 2, further comprising a jogger for jogging the sheets stacked on the first tray, wherein said controller controls said jogger not to jog the sheets when the sheet is a thin sheet.

5. Sheet processing apparatus according to claim 1, further comprising a detector for detecting a sheet stacked on said first tray, wherein said sheet processing apparatus receives a sheet from an image forming apparatus, wherein said discriminating unit discriminates whether the sheet stacked on said first tray is a thin sheet, wherein said controller controls said discharge unit not to discharge sheets even if the sheet is detected by said detector when the image forming apparatus starts an image formation in a case where the sheet is a thin sheet.

6. Sheet processing apparatus according to claim 5, wherein said controller controls said discharge unit to discharge sheets in accordance with the sheet being detected by said detector when the image forming apparatus starts an image formation in a case where the sheet is not a thin sheet.

7. Sheet processing apparatus according to claim 1, wherein said controller includes a counter for weighted counting of sheets stacked on said first tray, with weighting corresponding to a size of the sheet, and wherein said controller controls said discharge unit to discharge sheets in accordance with a count result of said counter exceeding a predetermined value.

8. Sheet processing apparatus according to claim 7, wherein said counter counts with weighting corresponding to a length of the sheet.

9. Sheet processing apparatus according to claim 1, further comprising a jogger for jogging sheets on said first tray, wherein said discriminating unit discriminates a width of a sheet, and wherein said controller controls said discharging unit to discharge sheets in accordance with a width of a coming sheet being different from a width of a sheet stacked on said first tray.

10. Sheet processing apparatus according to claim 1, wherein said discriminating unit discriminates whether a sheet is fed from a manual feeding unit, and wherein said controller controls said discharging unit to discharge a first predetermined number of sheets when it is discriminated that the sheets are being fed from a feeding unit other than the manual feeding unit and to discharge a second predetermined number of sheets, which is smaller than the first predetermined number of sheets, when it is discriminated that the sheets are being fed from the manual feeding unit.

11. Sheet processing apparatus according to claim 1, wherein said second tray moves vertically, and wherein said controller controls said second tray to move vertically.

12. Sheet processing apparatus according to claim 11, further comprising a stopper for stopping a sheet discharged on said second tray when said second tray moves up, wherein said controller controls said second tray to move down in accordance with a sheet being discharged onto said second tray and to move up in accordance with a top of stack on said second tray locating below said stopper.

13. Sheet processing apparatus according to claim 11, wherein said discharging unit includes a belt having a protrusion for moving sheets in a bundle toward said second tray, wherein said belt rotates for discharging sheets stacked on said first tray, and wherein said controller controls said second tray to move down before said protrusion passes by said second tray and to move up after said protrusion passes by said second tray.

14. Sheet processing apparatus according to claim 13, wherein said controller controls said belt to rotate when sheets are discharged to said second tray and to stop when said protrusion gets close to said second tray and to rotate when said second tray moves down until a predetermined position.

15. Sheet processing apparatus according to claim 1, further comprising image forming means for forming an image on a sheet to be discharged onto said first tray, a stapler for stapling sheets stacked on said first tray, a detector for detecting a sheet stacked on said second tray, a designation unit for designating that said stapler staples sheets, and an indicator for indicating that a sheet stacked on said second tray should be removed before said image forming means starts an image formation in accordance with a sheet being detected by said detector when said designation unit designates stapling, wherein said indicator will not indicate that a sheet stacked on said second tray should be removed when said designation unit does not designate stapling.

16. Sheet processing apparatus according to claim 15, further comprising a second controller for controlling said image forming means to form an image even if said indicator indicates that a sheet stacked on said second tray should be removed.

17. Sheet processing apparatus according to claim 15, further comprising a second discriminating unit for discriminating if said image forming means has formed a predetermined number of copy sets continuously, and a second controller for controlling said image forming means to stop forming an image when said second discriminating unit discriminates that said image forming means has formed a predetermined number of copies continuously.

18. Sheet processing apparatus according to claim 17, wherein said second controller controls said image forming means to start forming an image in accordance with the sheet not being detected by said detector.

19. Sheet processing method for controlling a sheet processing apparatus, said method comprising steps of:

stacking sheets transported from an upstream on a first tray;

discriminating a material of a sheet stacked on said first tray; and selectively controlling whether or not to discharge sheets from said first tray to a second tray in a bundle in accordance with a discrimination of said discriminating step.

20. A recording medium, which includes code for process steps that can be read by a controller of a sheet processing apparatus, said code comprising:

code for stacking sheets transported from an upstream on a first tray;

code for discriminating a material of a sheet to be stacked on said first tray; and code for selectively controlling whether or not to discharge sheets from said first tray to a second tray in a bundle in accordance with a discrimination by said discriminating code.

21. Sheet processing apparatus comprising:

a first tray for stacking sheets transported from an upstream;

a discharge unit for discharging the sheets from said first tray in a bundle;

a second tray for stacking the sheets discharged from said first tray;

a discriminating unit for discriminating an attribute of a sheet to be stacked on said first tray;

a jogger for jogging the sheets stacked on the first tray; and a controller for controlling said jogger not to jog the sheets when the sheet is a thin sheet.

22. Sheet processing apparatus comprising:

a first tray for stacking sheets transported from an upstream;

a discharge unit for discharging the sheets from said first tray in a bundle;

a second tray for stacking the sheets discharged from said first tray;

a discriminating unit for discriminating an attribute of a sheet to be stacked on said first tray;

a counter for weighted counting of sheets stacked on said first tray, with weighting corresponding to a size of the sheet; and a controller for controlling said discharge unit to discharge sheets in accordance with a count result of said counter exceeding a predetermined value.

23. Sheet processing apparatus according to claim 22, wherein said counter counts with weighting corresponding to a length of the sheet.

24. Sheet processing apparatus comprising:

a first tray for stacking sheets transported from an upstream;

a discharge unit for discharging the sheets from said first tray in a bundle;

a second tray for stacking the sheets discharged from said first tray;

a discriminating unit for discriminating a width of a sheet to be stacked on said first tray;

a jogger for jogging sheets on said first tray; and a controller for controlling said discharging unit to discharge sheets in accordance with a width of a coming sheet being different from a width of a sheet stacked on said first tray.

25. Sheet processing apparatus according to claim 24, wherein said controller controls said discharging unit to discharge sheets in accordance with a boundary signal.

26. Sheet processing apparatus according to claim 24, wherein said controller controls said discharging unit to discharge sheets upon a maximum amount of sheets being stacked on said first tray, the maximum amount being determined based on a plurality of size of sheets to be stacked on said first tray.

27. Sheet processing apparatus comprising:

a first tray for stacking sheets transported from an upstream;

a discharge unit for discharging the sheets from said first tray in a bundle;

a second tray for stacking the sheets discharged from said first tray;

a discriminating unit for discriminating whether a sheet is fed from a manual feeding unit; and a controller for controlling said discharging unit to discharge a first predetermined number of sheets when it is discriminated that the sheets are being fed from a feeding unit other than the manual feeding unit and to discharge a second predetermined number of sheets, which is smaller than the first predetermined number of sheets, when it is discriminated that the sheet are being fed from the manual feeding unit.

28. Sheet processing apparatus comprising:

a first tray for stacking sheets transported an upstream;

a discharge unit for discharging the sheets from said first tray in a bundle;

a second tray for stacking the sheets discharged from said first tray, said second tray moving vertically;

a stopper for preventing a succeeding bundle of sheets from dragging the sheet stacked on said second tray, said stopper moving away from said second tray when said second tray moves down; and a controller for controlling said second tray to move down in accordance with a sheet being discharged onto said second tray and to move up after a top of stack on said second tray locates below said stopper.

29. Sheet processing apparatus comprising:

a first tray for stacking sheets transported from an upstream;

a discharge unit for discharging the sheets from said first tray in a bundle;

a second tray for stacking the sheets discharged from said first tray, said second tray moving vertically; and a controller for controlling said discharge unit;

wherein said discharging unit includes a belt having a protrusion for moving sheets in a bundle toward said second tray, wherein said belt rotates for discharging sheets stacked on said first tray, and wherein said controller controls said second tray to move down before said protrusion passes by said second tray and to move up after said protrusion passes by said second tray.

30. Sheet processing apparatus according to claim 29, wherein said controller controls said belt to rotate when sheets are discharged to said second tray and to stop when said protrusion gets close to said second tray and to rotate when said second tray moves down until a predetermined position.

31. Sheet processing apparatus comprising:

a first tray for stacking sheets transported from an upstream;

a discharge unit for discharging the sheets from said first tray in a bundle;

a second tray for stacking the sheets discharged from said first tray;

image forming means for forming an image on a sheet to be discharged onto said first tray;

a stapler for stapling sheets stacked on said first tray;

a detector for detecting a sheet stacked on said second tray;

a designation unit for designating that said stapler staples sheets; and an indicator for indicating that a sheet stacked on said second tray should be removed before said image forming means starts an image formation in accordance with a sheet being detected by said detector when said designation unit designates stapling, wherein said indicator will not indicate that a sheet stacked on said second tray should be removed before said image forming means starts the image formation when said designation unit does not designate stapling even if a sheet is detected by said detector.

32. Sheet processing apparatus according to claim 31, further comprising a second controller for controlling said image forming means to form an image even if said indicator indicates that a sheet stacked on said second tray should be removed.

33. Sheet processing apparatus according to claim 31, further comprising a second discriminating unit for discriminating if said image forming means has formed a predetermined number of copies continuously, and a second controller for controlling said image forming means to stop forming an image when said second discriminating unit discriminates that said image forming means has formed a predetermined number of copies continuously.

34. Sheet processing apparatus according to claim 33, wherein said second controller controls said image forming means to start forming an image in accordance with the sheet not being detected by said detector.

35. Sheet processing apparatus comprising:

a first tray for stacking sheets transported from an upstream direction;

a discharge unit for discharging the sheets from said first tray in a bundle;

a second tray for stacking the sheets discharged from said first tray;

a discriminating unit for discriminating an attribute of a sheet to be stacked on said first tray; and a controller for controlling said discharge unit to discharge sheets when an amount of sheet stacked on said first tray reaches a maximum amount, wherein the maximum amount, in a case where the attribute of each sheet to be stacked on said first tray is the same, is different from the maximum amount, in a case where the attribute of at least one sheet to be stacked on said first tray is different from the attribute of another sheet to be stacked on said first tray.

36. Sheet processing apparatus according to claim 35, wherein the attribute is a size of sheet.

37. Sheet processing apparatus according to claim 35, wherein said controller controls and discharge unit to discharge sheets upon a boundary of sheet sets.

38. Sheet processing apparatus according to claim 37, wherein said sheet processing apparatus receives sheets from an image forming apparatus for forming an image on a sheet, and said controller controls said discharge unit to discharge sheet upon a boundary of image forming jobs.

39. Sheet processing apparatus comprising:

a first tray for stacking sheets transported from an upstream direction;

a discharge unit for discharging the sheets from said first tray in a bundle;

a second tray for stacking the sheets discharged from said first tray;

a discriminating unit for discriminating an attribute of a sheet to be stacked on said first tray; and a controller for controlling said discharge unit to discharge a maximum amount of sheets being stacked on said first tray, the maximum amount being determined based on a plurality of sizes of sheets to be stacked on said first tray.

40. Sheet processing apparatus according to claim 39, wherein the maximum amount is determined based on a number of sheets for each size of sheets.

41. Sheet processing apparatus according to claim 39, wherein said controllers controls said discharge unit to discharge sheets upon a boundary of sheet sets.

42. Sheet processing apparatus according to claim 41, wherein said sheet processing apparatus receives sheets from an image forming apparatus for forming an image on a sheet, and said controller controls said discharge unit to discharge sheets upon a boundary of image forming jobs.

* * * * *

UNITED STATES PATENT AND TRADEMARK OFFICE

CERTIFICATE OF CORRECTION

PATENT NO. : 6,471,429 B1
DATED : October 29, 2002
INVENTOR(S) : Yoshinori Isobe et al.

It is certified that error appears in the above-identified patent and that said Letters Patent is hereby corrected as shown below:

Column 1,
Line 44, “provides” should read -- provides a --.

Column 2,
Line 22, “provides Sheet” should read -- provides a sheet --.

Column 4,
Line 67, “a” should be deleted.

Column 5,
Line 7, “referred” should read -- referred to --.
Line 8, “sheet” should read -- sheets --.
Line 48, “interferes” should read -- interferes with --.

Column 6,
Line 2, “sheet” should read -- sheets --.
Line 58, “get” should read -- gets --.

Column 7,
Line 4, “423” should read -- 423 is --.
Line 47, “rotates” should read -- rotate --.

Column 10,
Line 11, “If” should read -- If the --.
Line 37, “receiving” should read -- receiving of --.

Column 11,
Line 61, “discharges” should read -- discharging --.

Column 12,
Line 14, “411” should read -- 411 are --.
Line 19, “thoe” should read -- the --.
Line 26, “in” should read -- is --.
Line 67, “sheet” should read -- sheet, and --.

Column 15,
Line 51, “sheet” should read -- sheets --.
Line 54, “an” should read -- from an --.

UNITED STATES PATENT AND TRADEMARK OFFICE

CERTIFICATE OF CORRECTION

PATENT NO. : 6,471,429 B1
DATED : October 29, 2002
INVENTOR(S) : Yoshinori Isobe et al.

It is certified that error appears in the above-identified patent and that said Letters Patent is hereby corrected as shown below:

Column 18,
Line 20, "controls" should read -- control --.

Signed and Sealed this

Seventeenth Day of June, 2003

JAMES E. ROGAN
*Director of the United States Patent and Trademark Office*